US010333282B2

(12) United States Patent
Ishida et al.

(10) Patent No.: US 10,333,282 B2
(45) Date of Patent: Jun. 25, 2019

(54) SPARK PLUG FOR INTERNAL COMBUSTION ENGINE

(71) Applicant: DENSO CORPORATION, Kariya, Aichi-pref. (JP)

(72) Inventors: Shohei Ishida, Nisshin (JP); Noriaki Nishio, Kariya (JP); Shun Sugita, Nisshin (JP); Yuya Abe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/037,332

(22) Filed: Jul. 17, 2018

(65) Prior Publication Data

US 2019/0027902 A1 Jan. 24, 2019

(30) Foreign Application Priority Data

Jul. 20, 2017 (JP) ..... 2017-140654

(51) Int. Cl.
*H01T 13/32* (2006.01)
*H01T 13/02* (2006.01)

(52) U.S. Cl.
CPC ..... *H01T 13/32* (2013.01); *H01T 13/02* (2013.01)

(58) Field of Classification Search
CPC ..... H01T 13/32; H01T 13/02
See application file for complete search history.

(56) References Cited

U.S. PATENT DOCUMENTS

2009/0026910 A1 1/2009 Tanaka et al.

FOREIGN PATENT DOCUMENTS

JP 2013-161523 8/2013

*Primary Examiner* — Anne M Hines
(74) *Attorney, Agent, or Firm* — Nixon & Vanderhye PC

(57) ABSTRACT

A spark plug includes a main ground electrode having a main connecting portion connected to the housing and forming a discharge gap between the main ground electrode and the center electrode, and a sub ground electrode having a sub connecting portion connected to the housing. The direction on which the main connecting portion and a plug center axis are arranged is set to be perpendicular to an air flow direction of an air stream in the combustion chamber. The sub connecting portion is located in a downstream side than the main connecting portion. The tip end position of the sub ground electrode in the plug axial direction is located in farther tip end side than that of the main ground electrode is. The sub ground electrode is configured such that an end point of the discharge spark is movable on the sub ground electrode.

11 Claims, 18 Drawing Sheets

SPARK PLUG FOR INTERNAL COMBUSTION ENGINE

CROSS-REFERENCE TO RELATED APPLICATION

This application is based on and claims the benefit of priority from earlier Japanese Patent Application No. 2017-140654 Jul. 20, 2017, the description of which is incorporated herein by reference.

BACKGROUND

Technical Field

The present disclosure relates to a spark plug for an internal combustion engine.

Description of the Related Art

As an ignition means of an internal combustion engine such as an engine of a vehicle, a spark plug has been used. Such a spark plug is configured to have a center electrode, a ground electrode and a discharge gap therebetween, where discharge is produced at the discharge gap. Sparks caused by the discharge make thermal contact with an air fuel mixture in the combustion chamber, thereby igniting the mixture in the combustion chamber.

For example, Japanese Patent Application Laid-Open Publication No. 2013-161523 discloses a spark plug having a plurality of ground electrodes to provide a plurality of discharge gaps. This spark plug produces a primary discharge at a discharge gap provided in the upstream side of the mixture in the combustion chamber, among the plurality of discharge gaps, thereby causing a primary plasma. The primary plasma flows together with an air fuel mixture stream in the combustion chamber and flows into the discharge gap located in the downstream side. The primary plasma flows into the discharge gap, thereby prompting occurrence of discharge at the discharge gap in the downstream side.

However, according to the spark plug disclosed in the above-mentioned patent literature, for example, in an environment where the air flow is likely to be faster in the combustion chamber due to a tumble engine or the like, it is difficult to have a primary plasma produced in the primary discharge gap in the upstream side stably flow into the discharge gap in the downstream side. Hence, it is considered that the spark plug according to the above-mentioned patent literature has to be improved in view of ignitability of the air fuel mixture.

SUMMARY

The present disclosure has been achieved in light of the above-described circumstances and to provide a spark plug of an internal combustion engine capable of improving ignitability of the air fuel mixture.

As a first aspect of the present disclosure, a spark plug of an internal combustion engine is provided in which the spark plug is capable of being attached to the internal combustion engine having a combustion chamber, producing a discharge spark in the combustion chamber.

The spark plug includes: a housing having a cylindrical shape; an insulator supported inside the housing; a center electrode supported inside the insulator; a main ground electrode having a main connecting portion connected to the housing and forming a discharge gap between the main ground electrode and the center electrode; and a sub ground electrode having a sub connecting portion connected to the housing at a portion different from the main connecting portion in a circumferential direction of the spark plug. A direction on which the main connecting portion and a plug center axis are arranged is set to be perpendicular to an air flow direction of an air stream in the combustion chamber, when viewed from a plug axial direction; The sub connecting portion is located in a downstream side of the air stream in the combustion chamber than a position of the main connecting portion; A tip end position of the sub ground electrode in the plug axial direction is located in farther tip end side than a tip end position of the main ground electrode in the plug axial direction is; and the sub ground electrode is configured such that an end point of the discharge spark is movable on the sub ground electrode, when the end point of the discharge spark produced in the discharge gap moves to the sub ground electrode from the main ground electrode.

The spark plug is configured such that when viewed from the plug axial direction, a direction on which the main connecting portion and the plug center axis are arranged is set to be perpendicular to the air flow direction of the air stream in the combustion chamber. Hence, the air flow towards the plug center axis can be prevented from being disturbed by the main ground electrode. Also, the sub connecting portion is provided further downstream in the air stream in the combustion chamber than the main connecting portion is. Hence, the air fuel mixture in the combustion chamber flows through a portion between the main ground electrode and the sub ground electrode. As a result, the discharge spark produced at a portion between the center electrode and the main ground electrode is extended towards the portion between the main ground electrode by the air stream of the air fuel mixture in the combustion chamber. The extended discharge spark is likely to approach the sub ground electrode so that the end point of the discharge spark is likely to move to the sub ground electrode from the main ground electrode.

The sub ground electrode is configured such that an end point of the discharge spark is movable on the sub ground electrode, when the end point of the discharge spark produced in the discharge gap moves to the sub ground electrode from the main ground electrode. Hence, the end point of the discharge spark moved to the main ground electrode from the sub ground electrode is influenced by the air stream, thereby moving on the surface of the sub ground electrode. Thus, the linear distance between both end points of the discharge spark S can readily be secured. Hence, a portion between both end points is likely to be extended, swelling significantly towards the downstream side. As a result, a contact area between the discharge spark and the air fuel mixture can be expanded, whereby ignitability of the air fuel mixture can be improved. In the case where the linear distance of the discharge spark between both end points is short, the discharge spark is likely to be shorted so that it is hard to extend the portion between both end points of the discharge spark. Therefore, as described above, by setting the linear distance between both end points of the discharge spark, a portion between both end points of the discharge spark S can readily be significantly extended to swell towards the downstream side.

Further, a tip end position of the sub ground electrode in the plug axial direction is located in farther tip end side than a tip end position of the main ground electrode in the plug axial direction. Hence, when the discharge spark moves to the sub ground electrode from the main ground electrode, the linear distance between both end points of the discharge spark is further extended so that the discharge spark can be more extended.

According to the above-described aspects, a spark plug of an internal combustion engine capable of improving an ignitability of the air fuel mixture can be provided.

Note that, the reference numerals in parentheses described in the claims and the means for solving the problems indicate the corresponding relationship between the specific means described in the following embodiments, and do not limit the technical range of the present invention.

DETAILED DESCRIPTION OF THE PREFERRED EMBODIMENTS (First Embodiment)

Figure 1:
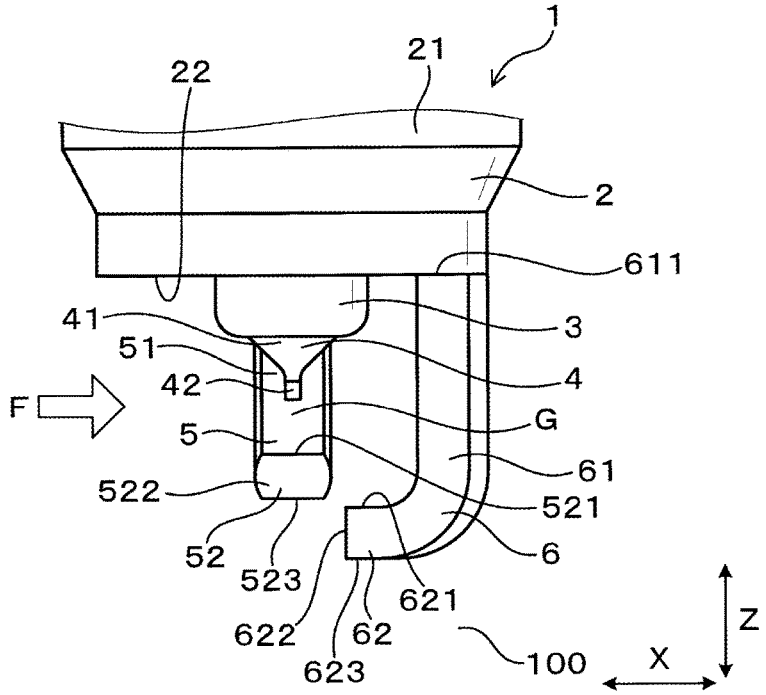
FIG. 1 is a diagram showing a front view of a spark plug according to a first embodiment of the present disclosure.
Figure 2:
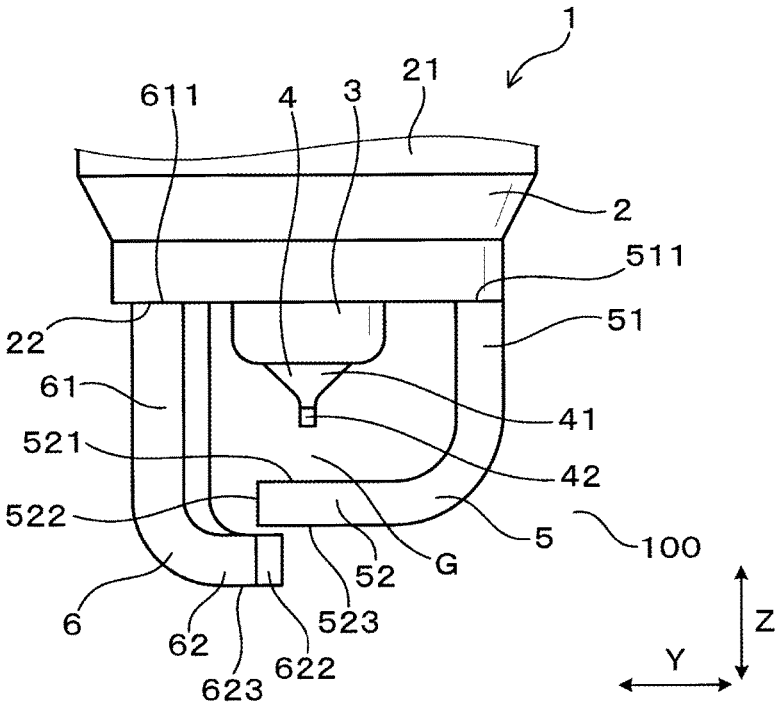
FIG. 2 is a diagram showing a side view of the spark plug according to the first embodiment.
Figure 3:
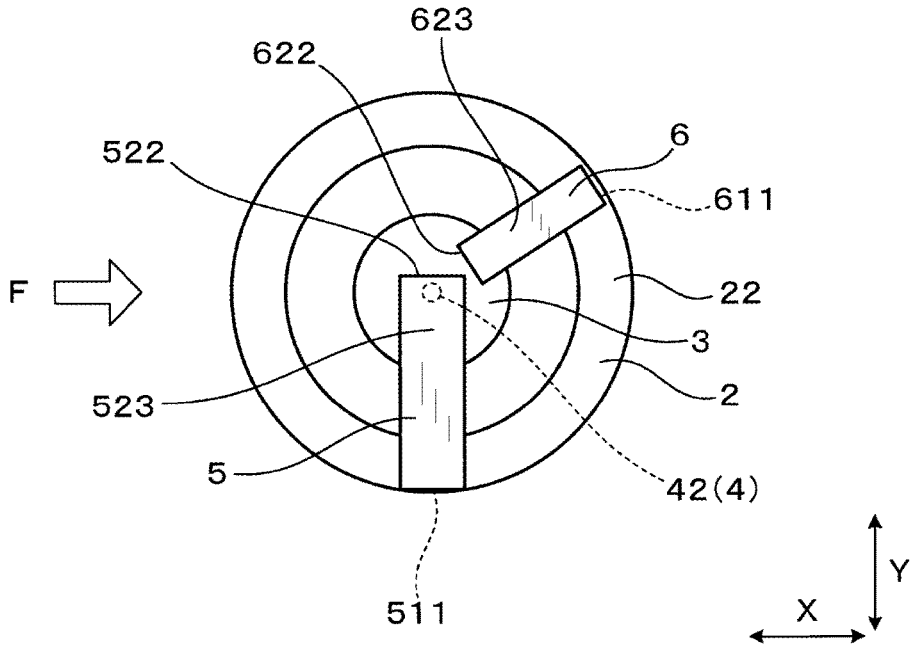
FIG. 3 is a diagram showing a plan view of the spark plug according to the first embodiment.

With reference to FIGS. 1 to 7, a spark plug 1 of an internal combustion engine will be described. The spark plug is attached to the internal combustion engine and produces a discharge spark in a combustion chamber of the internal combustion engine. As shown in FIGS. 1 to 2, the spark plug 1 for the internal combustion engine according to the first embodiment is provided with a housing 2 having a cylindrical shape, an insulator 3 having a cylindrical shape supported inside the housing 2, a center electrode 4 supported inside the insulator 3, a main ground electrode 5 and a sub ground electrode 6. The main ground electrode 5 includes a main connecting portion 511 connected to the housing 2. Also, the main ground electrode 5 forms a discharge gap G between the main ground electrode 5 and the center electrode 4. As shown in FIG. 3, the sub ground electrode 6 includes a sub connecting portion 611 connected to the housing 2 at a portion different from the main connecting portion 511 in the plug-circumferential direction. When viewed from the plug-axial direction Z, a direction on which the main connecting portion 511 and the plug center axis are arranged is set to be perpendicular to the air flow direction F of the air stream in the combustion chamber 100. In other words, a linear line that connects the main connecting portion 511 and the plug center axis intersects the air flow direction F. The sub connecting portion 611 is located in a downstream side of the air stream in the combustion chamber than the position of the main connecting portion 511. The tip end position of the sub ground electrode 6 in the plug axial direction Z is located in farther tip end side than the tip end position of the main ground electrode 5 in the plug-axial direction Z. The sub ground electrode 6 is configured such that the end point of the discharge spark is movable on the sub ground electrode 6, when the end point of the discharge spark produced in the discharge gap G moves to the sub ground electrode 6 from the main ground electrode 5. According to the first embodiment, the sub ground electrode 6 includes a sub stand portion 61 that stands towards a tip end side in the plug axial direction Z from the housing 2, and a sub inward portion 62 that extends towards inner periphery side of the plug in the radial direction thereof from the sub stand portion 61. The sub inward portion 62 is formed along the air flow direction F of the air stream. Thus, the spark plug 1 is configured such that the end point of the discharge spark can move on the sub inward portion 62 of the sub ground electrode 6. Hereinafter, detailed configuration of the spark plug 1 according to embodiments to will be described.

The spark plug 1 can be used as an ignition means in an internal combustion engine of a vehicle or a cogeneration apparatus, for example. The one end of the spark plug 1 in the plug axial direction Z is connected to an ignition coil (not shown) and the other end of the spark plug 1 in the plug axial direction Z is provided in the combustion chamber of the internal combustion engine.

In the specification, the plug axial direction Z refers to an axial direction of the spark plug 1, and the plug radial direction refers to a radial direction of the spark plug 1. The plug circumferential direction refers to a circumferential direction of the spark plug 1. Also, a side in which the spark plug 1 is inserted into the combustion chamber 100 refers to a tip end side and the opposite side thereof refers to a base end side.

The housing 2 has an attaching portion 21 with which the spark plug 1 is attached to an engine head by screwing or the like, the attaching portion 21 is being formed on the outer periphery surface of the housing 2. For example, by adjusting a screw-thread of the attaching portion 21, the attachment posture of the spark plug 1 in the internal combustion engine can be adjusted as well. Thus, the spark plug 1 can be configured such that a direction on which the main connecting portion 511 and the plug center axis are arranged is set to be perpendicular to the air flow direction F of the air stream in the combustion chamber 100.

The insulator 3 is configured such that the tip end portion is protruded towards the tip end side from the housing 2 and the base end portion is protruded towards the base end side from the housing, while being supported by the housing 2. The center electrode 4 is supported by the tip end portion in the insulator 3.

Figure 4:
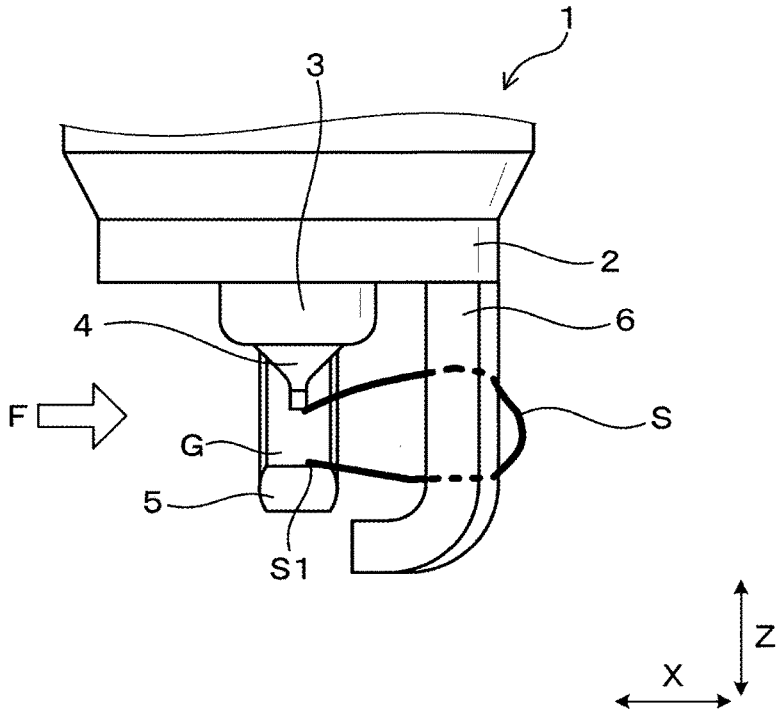
FIG. 4 is a diagram showing a front view of the spark plug illustrating a discharge between a main ground electrode and a center electrode according to the first embodiment.

The center electrode 4 is disposed such that the center axis thereof substantially coincides with the center axis of the spark plug 1. The center electrode 4 has a substantially cylindrical shape as a whole. The center electrode 4 is provided with a center electrode base 41 and the center electrode chip 42 disposed at the tip end face of the center electrode base 41, forming a discharge gap G between the main ground electrode 5 and the center electrode chip 42. In FIG. 4, the contour of the center electrode chip 42 is shown with a dotted line.

The main ground electrode 5 is joined with the tip end face 22 of the housing 2 at the main connecting portion 511. The main ground electrode 5 includes a main stand portion 51 that stands towards the tip end side from the housing in the plug axial direction Z, and a main inward potion 52 that is extended towards the inner periphery side in the plug radial direction from the main stand portion 51. Hereinafter, a direction on which the main connecting portion 511 and the plug center axis are arranged, is defined as a vertical direction Y. The vertical direction Y is perpendicular to the plug axis direction Z. Also, a direction perpendicular to both of the plug axis direction Z and the vertical direction Y is defined as a horizontal direction X.

The main stand portion 51 has a rectangular column shape and is formed in the plug axial direction Z. The thickness direction of the main stand portion 51 is defined as a vertical direction Y. The end face in the base end side of the main stand portion 51 corresponds to the main connecting portion 511. As shown in FIGS. 1 to 3, the entire surface of the main connecting portion 511 is connected to the top end face 22 of the housing 2.

The main inward portion 52 extends towards the inner periphery side in the radial direction from the end face of the tip end side. The main inward portion 52 has a rectangular column shape and is formed in the vertical direction Y. The thickness direction of the main inward portion 52 is defined as the plug axial direction Z. The main inward base surface 521 which is a base end side surface in the main inward portion 52 is provided such that a part of the main inward base surface 521 overlaps the tip end face of the center electrode chip 42 in the plug axial direction Z. In other words, the main inward base surface 521 faces the tip end face of the center electrode chip 42 and the plug axial direction Z. The discharge gap G is defined as a gap between the main inward base surface 521 and the tip end face of the center electrode chip 42 in the plug axial direction Z. The main inward end face 522 which is an end face of the main inward portion 52 in the vertical direction Y is disposed at an opposite side of the main connecting portion 511 in the vertical direction Y rather than the plug center axis.

As shown in FIG. 3, the sub ground electrode 6 is joined with the tip end face 22 of the housing 2 at the sub connecting portion 611. The sub connecting portion 611 is joined with the tip end face 22 of the housing 2 at a portion away from the main connecting portion 511 by less than 180 degrees. According to the present embodiment, the sub connecting portion 611 is joined with the tip end face 22 of the housing 2 at a portion shifted from the main connecting portion 511 by a range from 90 degrees to less than 180 degrees. The sub connecting portion 611 is disposed at a portion not to overlap the plug center axis in the air flow direction F.

The sub ground electrode 6 includes, as described above, the sub stand portion 61 that stands towards the tip end side from the housing 2 in the plug axial direction Z, and the sub inward portion 62 extended towards the inner periphery side from the sub stand portion 61 in the plug radial direction.

The sub stand portion 61 has a rectangular column shape and is formed in the plug axial direction Z. The thickness direction of the sub stand portion 61 is defined as a direction, among directions perpendicular to the plug axial direction Z, along which the sub connecting portion 611 and the plug center axis are arranged. The base end side end face of the sub stand portion 61 corresponds to the sub connecting portion 611. The entire surface of the sub connecting portion 611 is connected to the tip end face 22 of the housing 2.

The sub inward portion 62 extends towards the inner periphery side in the radial direction of the plug from the end portion in the tip end side of the sub stand portion 61. The sub inward portion 62 has a rectangular column shape and is formed in the plug radial direction. As described above, the sub inwards portion 62 is formed along the air flow direction F of the air stream in the combustion chamber 100. Here, a feature of "the sub inwards portion 62 is formed along the air flow direction F of the air stream" includes a feature of "the sub inward portion 62 is formed to be parallel to the air flow direction F of the air stream" and a feature of "the sub inward portion 62 is formed substantially parallel to the air flow direction F of the air stream". The feature of "the sub inward portion 62 is formed to be substantially parallel to the air flow direction F of the air stream" may be defined such that the angle formed between the formation direction of the sub inward portion 62 and the air flow direction F is 45 degrees or less. According to the present embodiment, the sub inward portion 62 is formed to be inclined with respect to the air flow direction F of the air stream in the combustion chamber 100.

A sub inward tip end face 623 which is a tip end side surface of the sub inward portion 62 is located in the tip end side in the plug axial direction Z compared to a main inward tip end face 523 which is a tip end side surface of the main inward portion 52. Thus, the tip end of the sub ground electrode 6 in the plug axial direction Z is located in the tip end side than the tip end position of the main ground electrode 5 with respect to the plug axial direction Z.

The thickness direction of the sub inward portion 62 corresponds to the plug axial direction Z. Unlike the main inwards base surface 521, a sub inward base surface 621 which is a surface of the base end side in the sub inward portion 62 does not overlap the tip end face of the center electrode chip 42 and the plug axial direction Z. That is, a sub inward end face 622 which is an end face opposite to the sub stand portion 61 is located in the sub connecting portion 611 side than the tip end face of the center electrode chip 42 is, with respect to a direction on which the plug center axis and the sub connecting portion 611 are arranged. Also, the sub inward base surface 621 of the sub inward portion 62 is located in the tip end side in the plug axial direction Z than the main inward base face 521 of the main inward portion 52 is. Thus, the distance between the sub inward base surface 621 of the sub inward portion 62 and the center electrode 4 in the plug axial direction Z is longer than the discharge gap G.

The main ground electrode 5 and the sub ground electrode 6 is formed by, for example, bending a long metal plate in the thickness direction.

The spark plug 1 is attached to the engine head in a posture where a direction (i.e., horizontal direction X) perpendicular to a direction on which the main connecting portion 511 and the plug center axis are arranged (i.e., vertical direction Y) becomes an air stream direction of the air fuel mixture passing through the discharge gap G. Thus, the air stream flowing through the tip end portion of the spark plug 1 passes between the main ground electrode 5 and the sub ground electrode 6 in the horizontal direction X, after passing through the discharge gap G.

Hereinafter, with reference to FIGS. 4 to 7, an example of a state of the discharge spark S is illustrated where the discharge speak S produced in the spark plug 1 is extended by the air stream.

Figure 5:
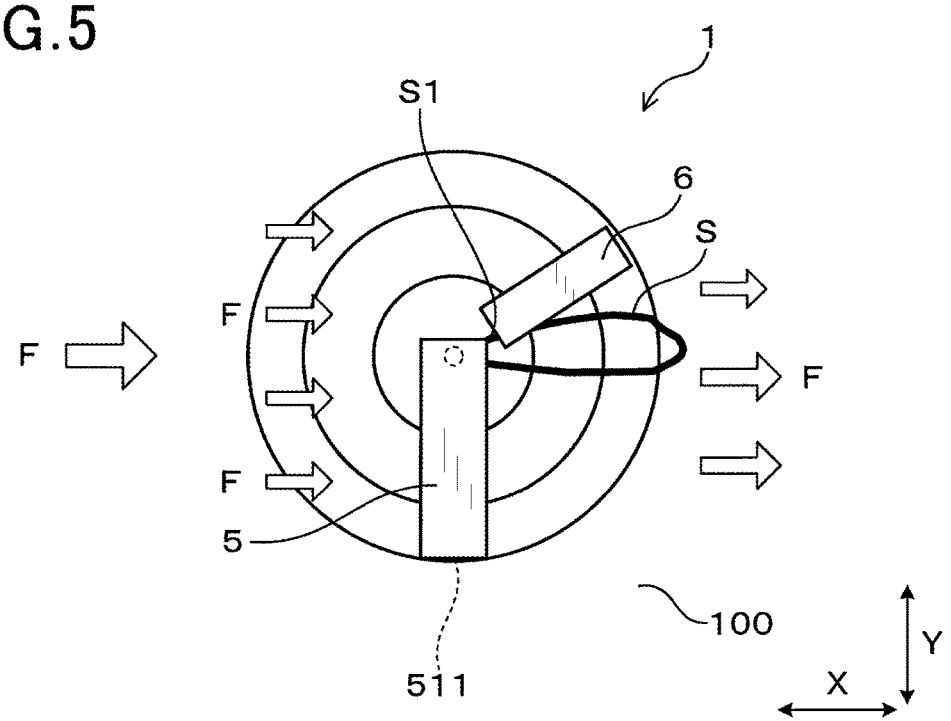
FIG. 5 is a diagram showing a plan view of the spark plug illustrating a state where a discharge spark is extended between the main electrode and the center electrode according to the first embodiment.
Figure 6:
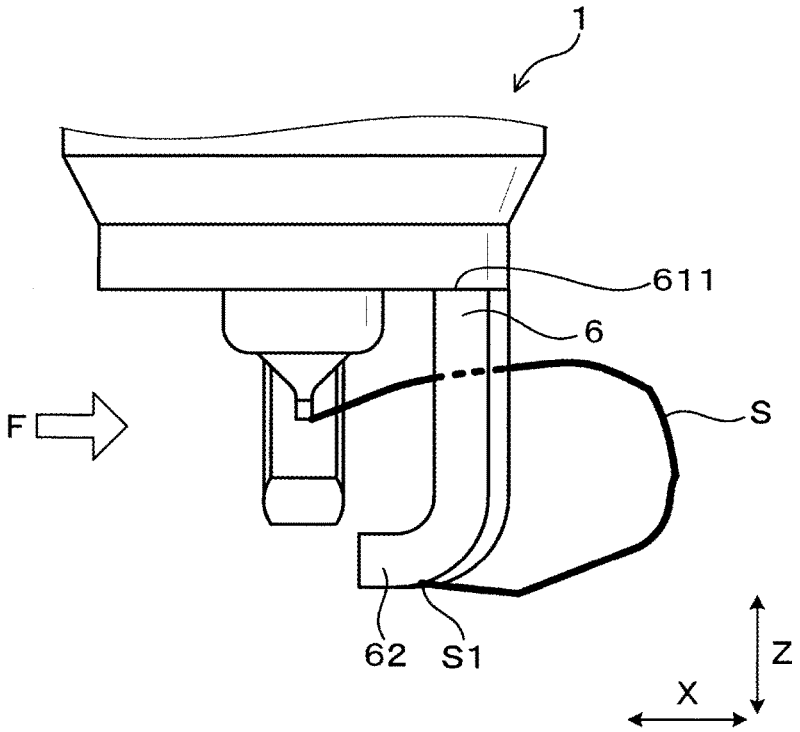
FIG. 6 is a diagram showing a front view of the spark plug illustrating a state where a discharge spark is extended between the sub ground electrode and the center electrode according to the first embodiment.
Figure 7:
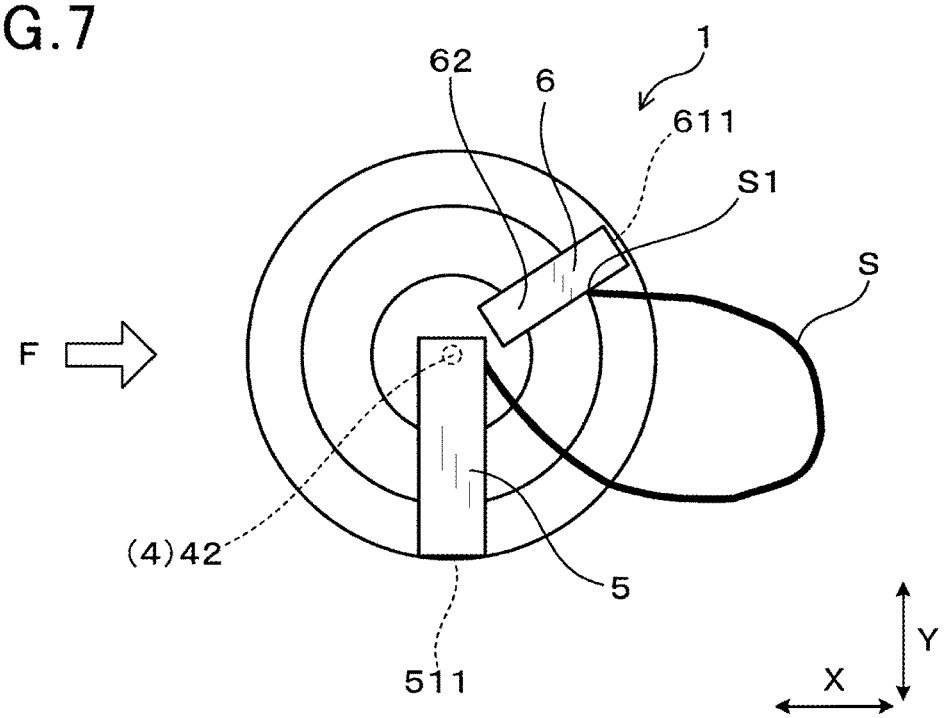
FIG. 7 is a diagram showing a plan view of the spark plug illustrating a state where a discharge spark is extended between the sub ground electrode and the center electrode according to the first embodiment.

First, a discharge occurs at the discharge gap G by applying a predetermined voltage to the center electrode 4. The discharge spark S produced by the discharge in the discharge gap G is pushed by the air stream in the combustion chamber 100 and extended such that a portion between both end points of the discharge spark S grow towards the down stream side. In other words, as shown in FIG. 5, the discharge spark S is extended, swelling towards a gap between the main ground electrode 5 and the sub ground electrode 6. Thus, as shown in FIGS. 6 and 7, a part of the discharge spark S approaches the sub ground electrode 6 and the end point of the discharge spark S which is opposite to the end point at the center electrode 4 moves to the sub ground electrode 6 from the main ground electrode 5. Hereinafter, the end point of the discharge spark S which is opposite to the end point at the center electrode 4 may be referred to as a ground side end point S1.

The ground side end point S1 of the discharge spark S moves to the sub ground electrode 6 from the main ground electrode 5, whereby the distance Z between both end points of the discharge spark S in the plug axial direction Z becomes large and the linear distance between both end points of the discharge spark S becomes large as well.

The ground side end point S1 of the discharge spark S moves from the main ground electrode 5, creeping on the corner of the sub inward portion 62 of the sub ground electrode 6. The portion between both end points of the discharge spark S is extended, significantly swelling towards the downstream side, while the ground side end point S1 of the discharge spark S moves on the corner potion of the sub inward portion 62 towards a direction on which the plug center axis and the sub connecting portion 611 are arranged. Thus, the discharge spark S further extends the linear distance between both end points and the portion between both end points being significantly swelled towards the downstream side. As shown in FIG. 6, the discharge spark S significantly swells in the plug axial direction as well and also swells in the vertical direction Y as shown in FIG. 7.

Next, effects and advantages of the present embodiments will be described. The spark plug 1 of the present embodiment is configured such that the direction on which the main connecting portion 511 and the plug center axis are arranged crosses the air flow direction F of the air stream in the combustion chamber 100, when viewed from the plug axial direction Z. Hence, the air stream flowing towards the plug center axis can be prevented from being disturbed by the main ground electrode 5. The sub connecting portion 611 is disposed in the downstream side of the air stream in the combustion chamber 100 than the main connecting portion 511 is. Therefore, the air fuel mixture in the combustion chamber 100 flows through a portion between the main ground electrode 5 and the sub ground electrode 6. Thus, the discharge spark S produced between the center electrode 4 and the main ground electrode 5 is extended towards a portion between the main ground electrode 5 and the sub ground electrode 6 by the stream of the air fuel mixture. The extended discharge spark S is likely to approach the sub ground electrode 6 so that the end point readily moves towards the sub electrode 6 from the main ground electrode 5.

The sub ground electrode 6 configured such that the end point of the discharge spark S is able to move when the end point of the discharge spark S produced in the discharge gap G moves to the sub ground electrode 6 from the main ground electrode 5. Hence, the end point of the discharge spark S which is reached to the sub ground electrode 6 from the main ground electrode 5 is likely to move along the air flow direction F. Thus, the linear distance between both end points of the discharge spark S can readily be secured. Hence, a portion between both end points is likely to be extended, swelling significantly towards the downstream side. As a result, a contact area between the discharge spark S and the air fuel mixture can be expanded, whereby ignitability of the air fuel mixture can be improved. In the case where the linear distance of the discharge spark S between both end points is short, the discharge spark S is likely to be shorted so that it is hard to extend the portion between both end points of the discharge spark S. Therefore, as described above, by setting the linear distance between both end points of the discharge spark, a portion between both end points of the discharge spark S can readily be significantly extended to swell towards the downstream side.

The tip end of the sub ground electrode 6 in the plug axial direction Z is located in the tip end side than the tip end of the main ground electrode 5 in the plug axial direction Z. Hence, when the discharge spark moves to the sub ground electrode 6 from the main ground electrode 5, the linear distance between both end points of the discharge spark S is further extended so that the discharge spark S can be more extended (stretched).

Also, the sub inward portion is formed along the air flow direction F. Hence, the end point of the discharge spark S which is reached to the sub ground electrode 6 is likely to move along the air flow direction F. Thus, the linear distance between both end points of the discharge spark S is further extended so that the discharge spark S can be more extended.

As described, according to the present embodiment, a spark plug for an internal combustion engine capable of improving ignitability of air fuel mixture can be provided.

(Comparative Example)

Figure 8:
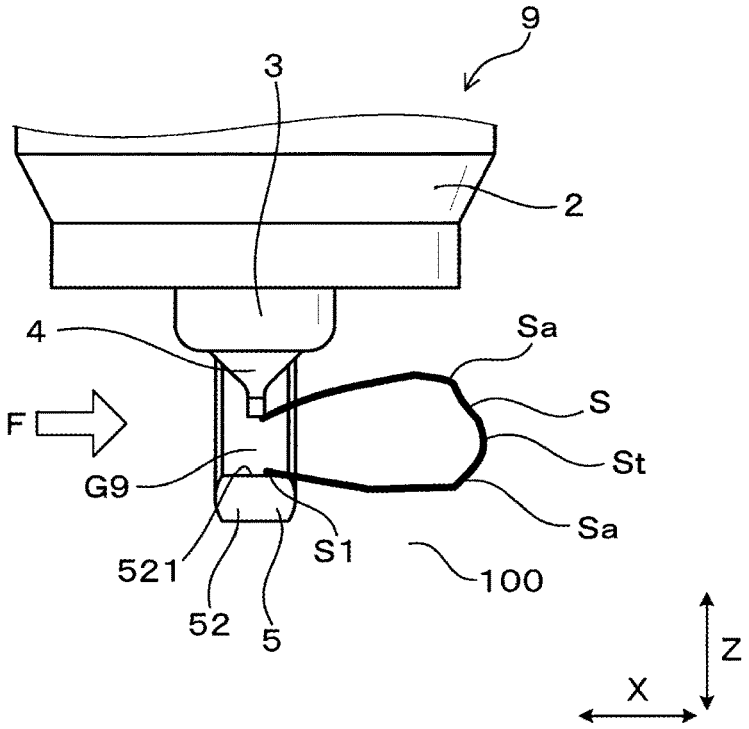
FIG. 8 is a diagram showing a front view of the spark plug illustrating a state where a discharge spark is extended between the sub ground electrode and the center electrode according to a comparative example.
Figure 9:
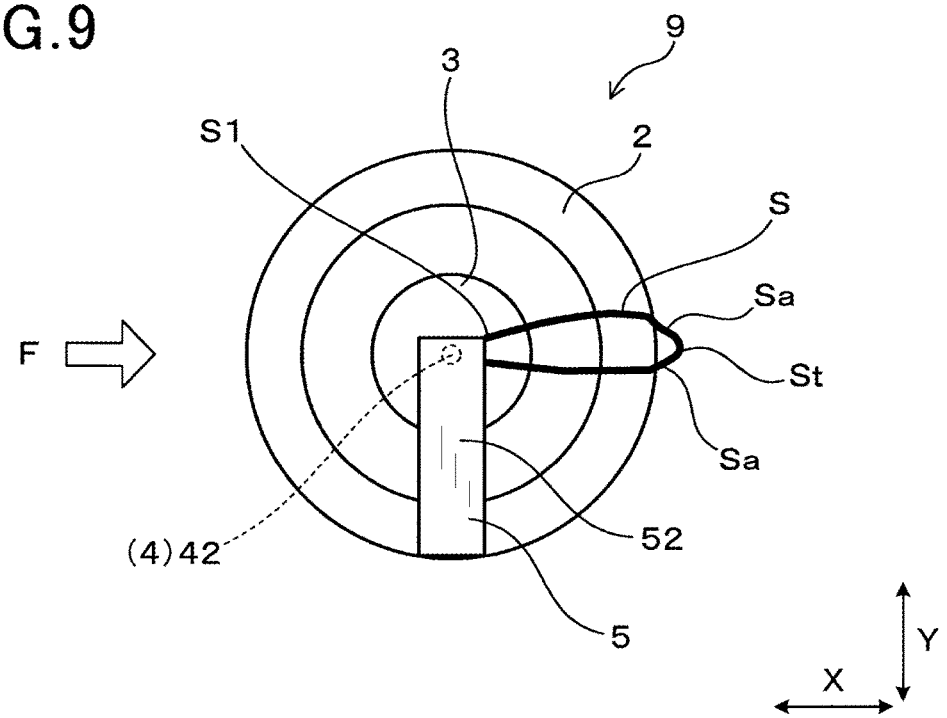
FIG. 9 is a diagram showing a plan view of the spark plug illustrating a state where a discharge spark is extended between the sub ground electrode and the center electrode according to the comparative example.
Figure 10:
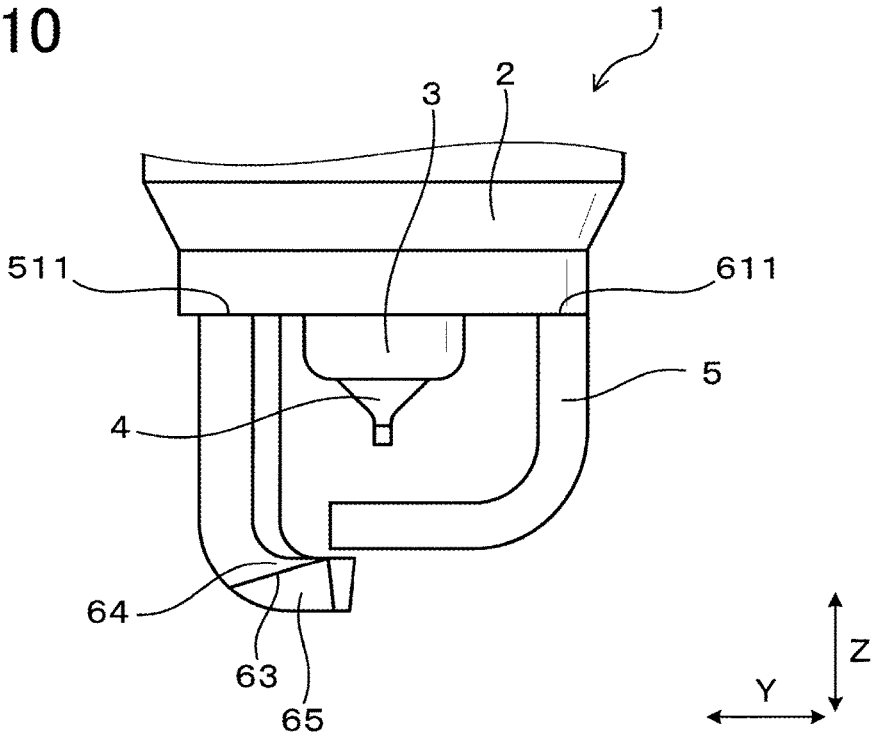
FIG. 10 is a diagram showing a side view of a spark plug according to a second embodiment.
Figure 11:
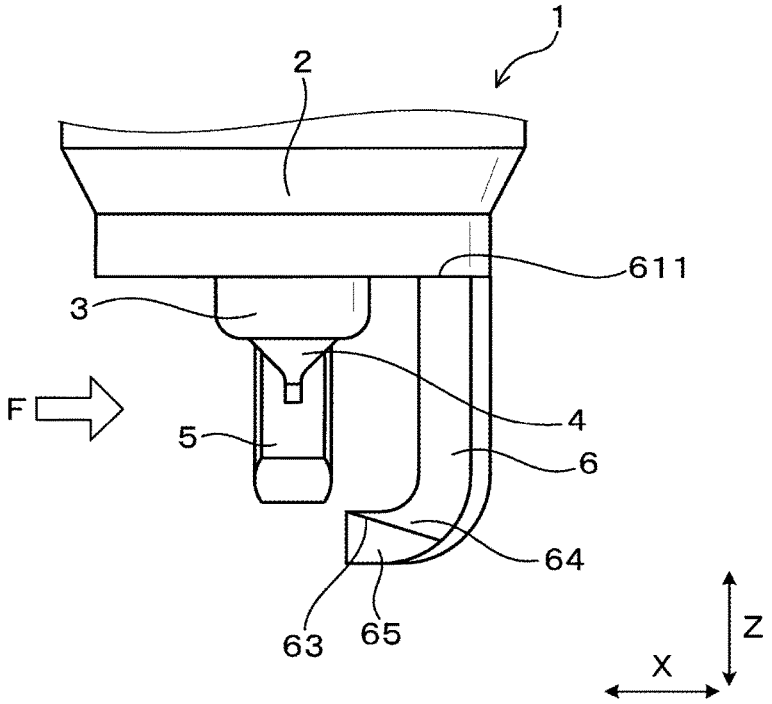
FIG. 11 is a diagram showing a front view of the spark plug according to the second embodiment.
Figure 12:
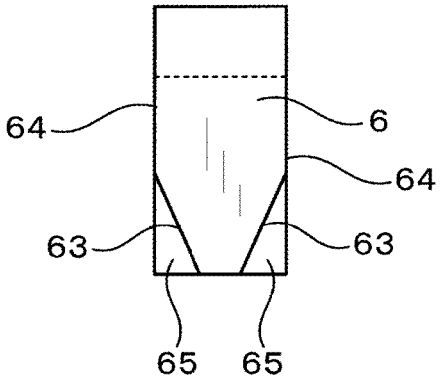
FIG. 12 is a diagram showing a plan view of the sub ground electrode according to the second embodiment.
Figure 13:
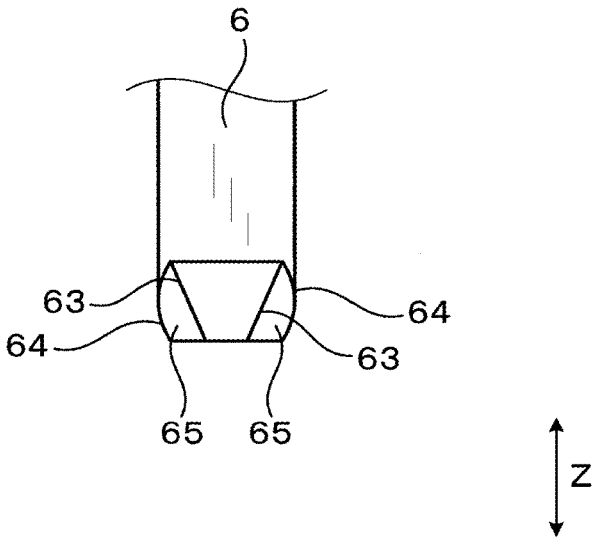
FIG. 13 is a diagram showing the sub ground electrode when viewed from a formation direction of a sub inward portion.

As shown in FIGS. 8 and 9, the comparative example excludes a sub ground electrode from the first embodiment. That is, according to the comparative example, the discharge gap S is formed between the center electrode 4 and only the main ground electrode 5. Other configurations are the same as those of the first embodiment. Hereinafter, the same configuration as that of the first embodiment will be described with the same name.

Next, with reference to FIGS. 8 and 9, an example of a state will be described in which the air stream extends the discharge spark S produced in the spark plug S according to the comparative example.

The discharge spark S in the initial state is produced between the center electrode 4 and the main inward base surface 521 of the main inward portion 52. As shown in FIGS. 8 and 9, the discharge spark S is pushed by the air stream so that the portion between both end points sharply expand in the downstream side. In other words, according to the comparative example, unlike the first embodiment, the ground electrode is not present so that the discharge spark S does not move between electrodes at the ground side end point S1. Hence, distance between both end points of the discharge spark S is not sufficient. Therefore, the more extended the portion between both end points of the discharge spark S to the downstream side, the larger the curvature of the folded part St which is a portion located at the most downstream side of the discharge spark is. As a result, as the portion between both end points of the discharge spark S is extended to the downstream side, adjacent portions Sa located in both side of the folded portion St in the discharge spark S are likely to approach to each other and eventually become shorted. Due to occurrence of this short, it is difficult for the portion between both end points of the discharge spark S to become elongated, and swelling in the downstream side.

On the other hand, according to the first embodiment, as described above, the distance between both end points of the discharge spark S can be extended in both the plug axial direction Z and the vertical direction Y or also in the linear distance. As a result, occurrence of short due to excessively high curvature of the downstream side end portion of the discharge spark S can be avoided so that the discharge spark S can be extended to the downstream side.

(Second Embodiment)

As shown in FIGS. 10 to 13, according to the second embodiment, a shape of the sub ground electrode 6 is changed from the first embodiment. Specifically, the sub inward portion 62 has an edge portion 63 which is continuously formed to have a linear shape. The edge portion 63, when being closer to the downstream side, is inclined towards the tip end side of the plug axial direction Z. The sub inward portion 62 includes a sub inward side surface 64 which is perpendicular to the width direction of the sub inward portion 62, and a sub taper surface 65 which is adjacent to the sub inward side surface 64. The sub taper surface 65 is configured such that the closer to the radial direction outer periphery side, the closer to the outside in the width direction of the sub inward portion. Also, the sub taper surface 65 is inclined towards the inward with respect to the width direction, when being closer to the tip end side of the plug axial direction Z. The boundary portion between the sub inwards side surface 64 and the sub taper surface 65 is defined as the edge portion 63.

For example, the sub taper surface 65 is formed by cutting two corner portions of the tip end side to be in planar shape in the sub inward portion 62 formed in a rectangular column shape. The sub taper surface 65 is adjacent to the sub inwards end face 622, a surface in the tip end side of the sub inward portion 64. The edge portion 63 is formed sharply such that electric field is concentrated therearound. The edge portion 63 is not necessarily formed in horn shape as long as electric field concentrates therearound. For example, the edge portion 63 may be formed in a curved shape having large curvature.

The sub ground electrode 6 can be formed by for example, bending a long metal plate material its thickness direction and cutting the side surface of the taper portion and the side surface of the ground base tip end.

Other configurations are the same as those in the first embodiment. In the reference signs used after the second embodiment, configurations having the same reference signs in the existing embodiments represent the same elements in the existing embodiments unless otherwise specified.

According to the second embodiment, when being closer towards the downstream side, the edge portion 63 of the sub inward portion 62 is inclined towards the tip end side in the plug axial direction Z. Hence, the distance and the linear distance between the both end points of the discharge spark S can readily be extended. In other words, the ground side end point S1 of the discharge spark S moved to the sub ground electrode 6 from the main ground electrode 5 moves by creeping on the edge portion 6 provided at the sub inward portion 62. Thus, each of the distance between both end points of the discharge spark S in the plug axial direction Z and the distance in the plug radial direction can be extended. Thus, the portion between both end points of the discharge spark S can be further swelled, thereby further improving the ignitability of the air fuel mixture.

The boundary portion between the sub inward side portion 64 and the sub taper surface 65 is defined as the edge portion 63. Hence, the edge portion 63 can readily be formed so that productivity of the spark plug 1 can be improved. Further, similar effects and advantages to the first embodiment can be obtained.

(Third Embodiment)

Figure 14:
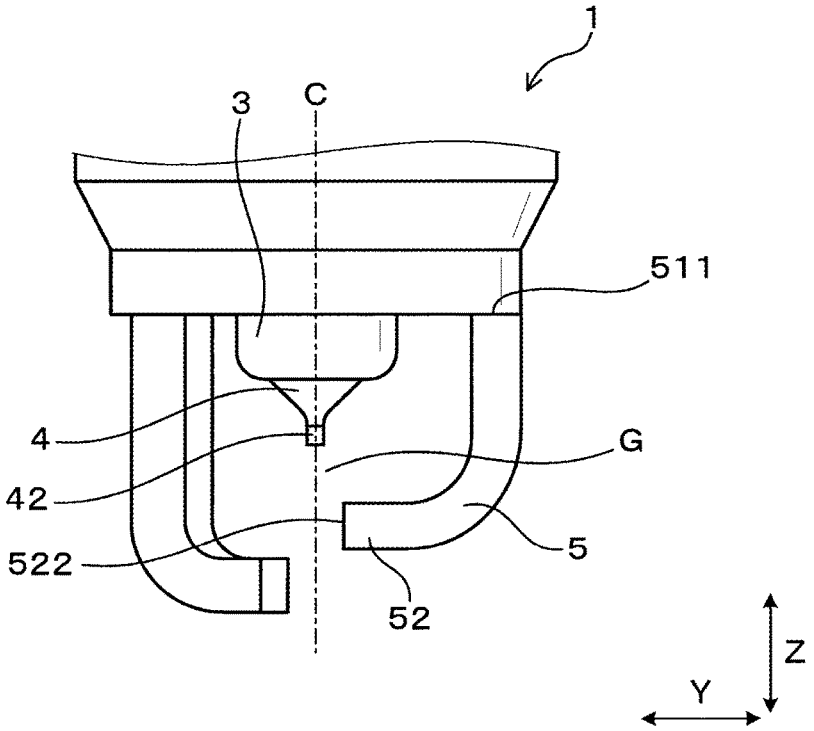
FIG. 14 is a diagram showing a side view of a spark plug according to a third embodiment.
Figure 15:
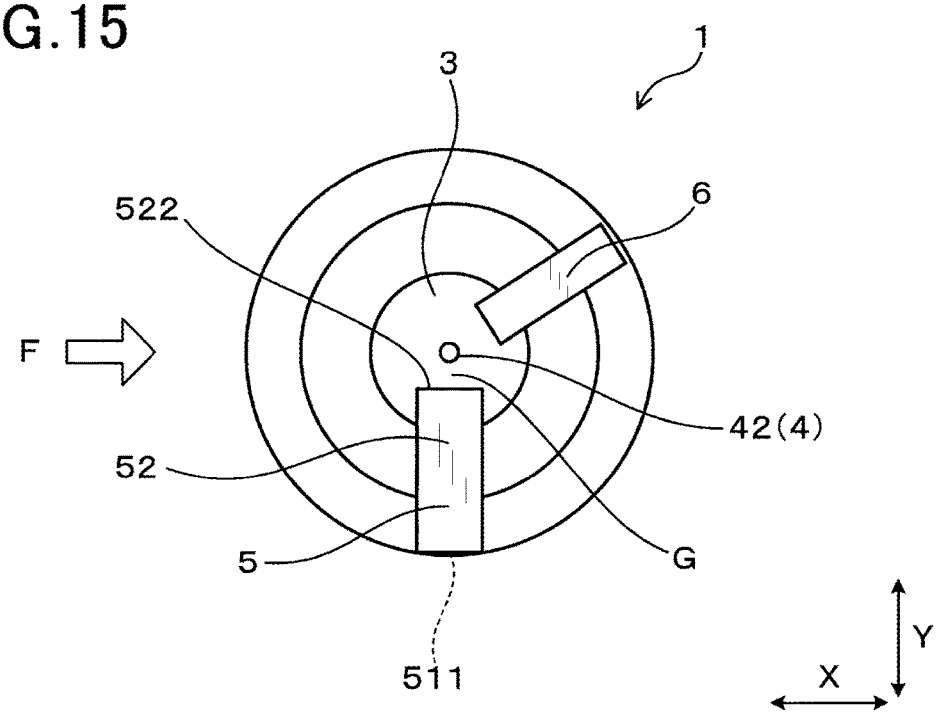
FIG. 15 is a diagram showing a plan view of the spark plug according to the third embodiment.

As shown in FIGS. 14 and 15, the third embodiment has a configuration in which a main inward end face 522 which is an end face in the inner periphery side of the main inward portion 52 in the plug radial direction is located in the main connecting portion 511 side than the plug center axis C. Thus, according to the present embodiment, the center electrode 4 and the main ground electrode 5 do not face each other in the plug axial direction Z. The discharge gap G between the center electrode 4 and the main ground electrode 5 is formed to be slightly inclined towards the plug axial direction Z. Thus, according to the present embodiment, the initial spark discharge formed between the center electrode 4 and the main ground electrode 5 is formed slightly extending towards an outer periphery side in the radial direction from the tip end face of the center electrode chip 42. Note that the center electrode 4 represents only the center electrode chip 42 in FIG. 15.

According to the present embodiment, the distance between the initial discharge spark S and the surface of the tip end portion of the insulator 3 can be shortened. Hence, even in the case where carbon or the like is accumulated on the surface of the insulator 3 in a state where the combustion temperature in the internal combustion engine is relatively low when starting the internal combustion engine starts with low temperature environment, with the discharge spark S, carbon can be burned off. Accordingly, a so-called smoldering phenomenon can be avoided. Further, the same effects and advantages as the first embodiment can be obtained.

(Fourth Embodiment)

Figure 16:
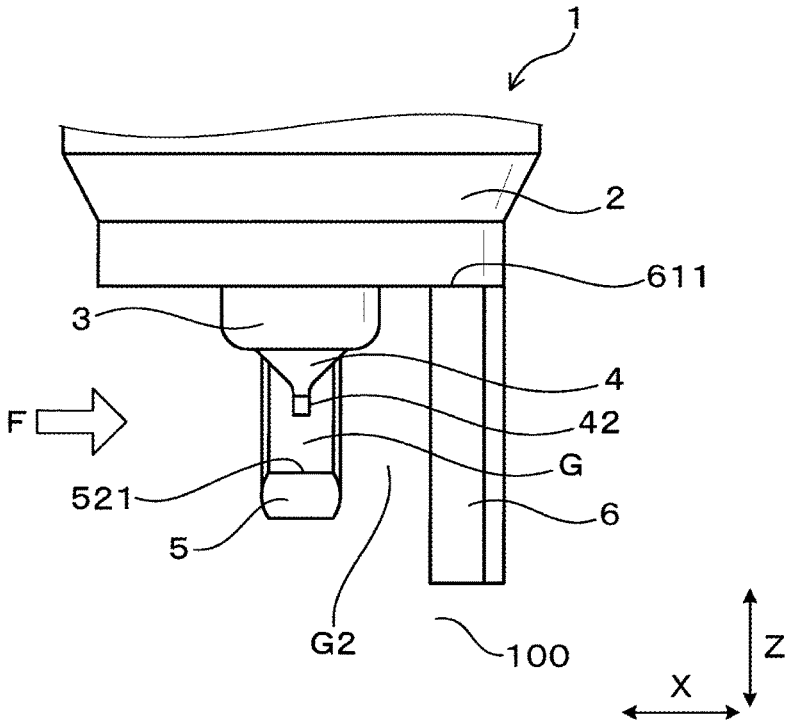
FIG. 16 is a diagram showing a front view of a spark plug according to a fourth embodiment.
Figure 17:
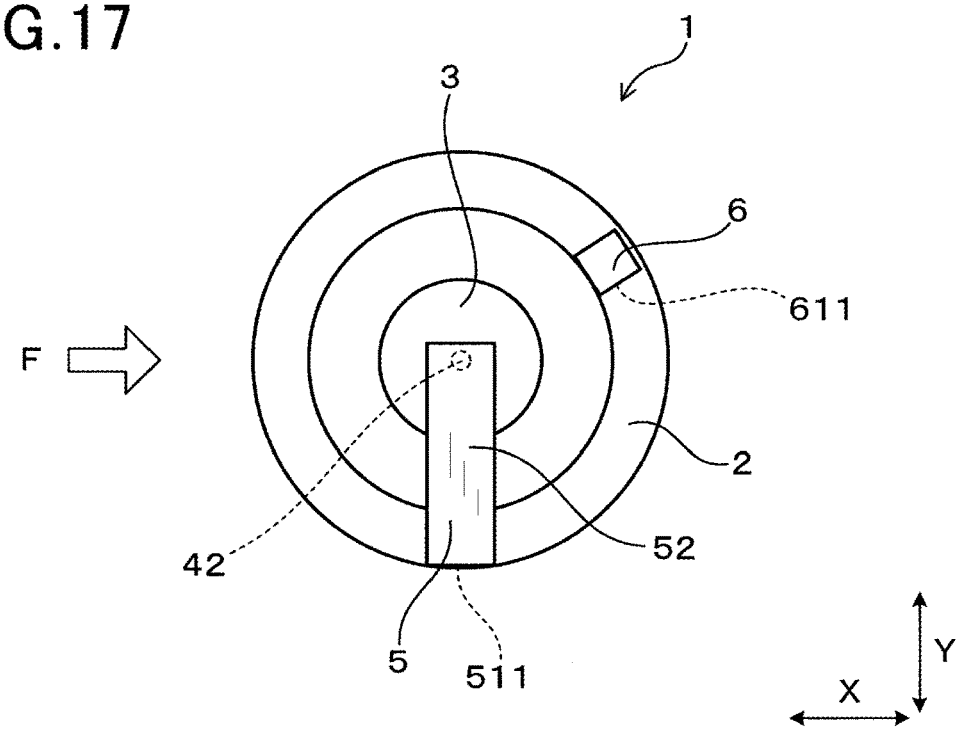
FIG. 17 is a diagram showing a plan view of the spark plug according to the fourth embodiment.

As shown in FIGS. 16 and 17, the fourth embodiment has a configuration in which the sub ground electrode 6 is formed in a rectangular column shape extending in the plug axial direction Z. Specifically, according to the present embodiment, the sub ground electrode 6 does not have a configuration corresponding to the sub inward portion of the first embodiment. The tip end position of the sub ground electrode 6 is located in farther tip end side than the main inward base surface 521 is. The present embodiment is configured such that the end point of the discharge spark is capable of moving on the sub ground electrode 6 towards the tip end side in the plug axial direction Z. Other configurations are the same as those of the first embodiment.

According to the present embodiment, the ground side end point S1 of the discharge spark S which is moved to the sub electrode 6 from the main ground electrode 5 can readily move on the corner portion in the inner periphery side of the sub ground electrode 6 in the plug axial direction Z. Hence, the distance between both end points of the discharge spark S can be extended in the plug axial direction Z easily. Thus, the tip end side of the discharge spark S can be significantly extended in the tip end side. As a result, it is likely to avoid a fire extinguish effect where combustion heat produced by the discharge spark S is absorbed by an engine head in the combustion chamber 100 when the discharge spark S approaches the engine head. Therefore, ignitability of the air fuel mixture can be further improved.

According to the present embodiment, the shape of the sub ground electrode 6 can be simplified so that productivity of the spark plug 1 can be improved. Other than this, similar effects and advantages to the first embodiment can be obtained according to the present embodiment.

(Fifth Embodiment)

Figure 18:
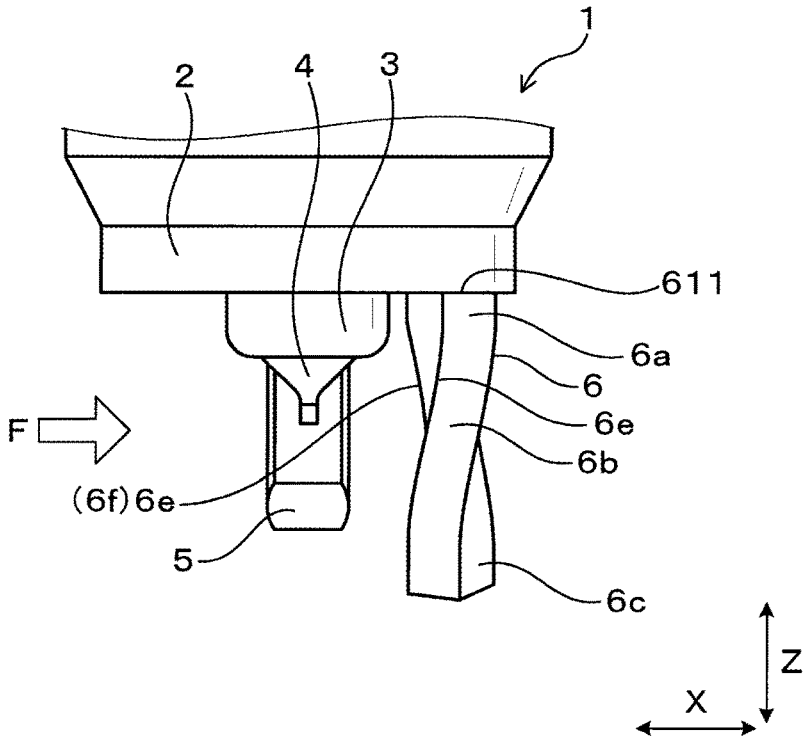
FIG. 18 is a diagram showing a front view of a spark plug according to a fifth embodiment.
Figure 19:
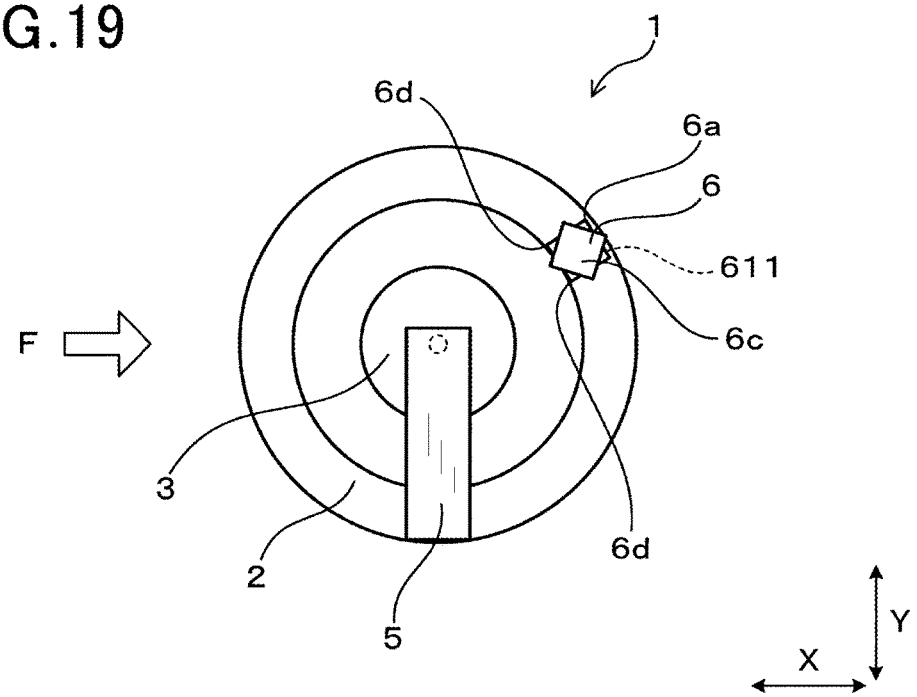
FIG. 19 is a diagram showing a plan view of the spark plug according to the fifth embodiment.

As shown in FIGS. 18 and 19, the fifth embodiment has a basic structure as same as that of the fourth embodiment, but the shape of the sub ground electrode 6 is changed. According to the present embodiment, the sub ground electrode 6 has a twisted shape in which the center portion in the plug axial direction of the metal material having the rectangular column shape extending in the plug axial direction is twisted by 45°. That is, the sub ground electrode 6 includes a root portion 6*a* having a sub connecting portion 611 and formed in a rectangular column shape, a twisted portion 6*b* extending from the root portion 6*a* towards the tip end side, being twisted with respect to the plug axial direction Z as the center thereof, and a tip end column portion 6*c* extending towards further tip end side from the twisted portion 6*b*. Thus, when viewed from the plug axial direction Z, postures of the root portion 6*a* and the tip end column portion 6*c* are mutually shifted in the circumferential direction by 45°.

When viewed from the tip end side, the root portion 6*a* has a thickness in a direction on which the sub connecting portion 611 and the plug center axis are arranged, and has a pair of inward corner portions 6*d* in both sides each facing the plug axial direction side. The twisted portion 6*b* includes a pair of twisted corner portion 6*e* continued from the pair of inward corner portion 6*d*. As shown in FIG. 18, a specific twisted portion 6*f* is provided as one of the pair of twisted corner portions 6*e*. The specific twisted portion 6*f* is configured to extend towards outer periphery side in the radial direction as it goes towards the tip end side. Then, the corner portion of the tip end column portion 6*c* is formed to be in straight in the plug axial direction Z. Other configurations are the same as those of the fourth embodiment.

According to the present embodiment, the ground side end point S1 moved to the sub ground electrode 6 from the main ground electrode 5 moves spirally on the specific twisted corner portion 6*f*. Thus, the ground side end point S1 of the discharge spark S moving on the specific twisted portion 6*f* moves radially towards the outer side. Accordingly, the linear distance between both end points of the discharge spark S can readily be extended so that the ignitability of the air fuel mixture can be improved. Other than this, similar effects and advantages to the fourth embodiment can be obtained according to the present embodiment.

(Sixth Embodiment)

Figure 20:
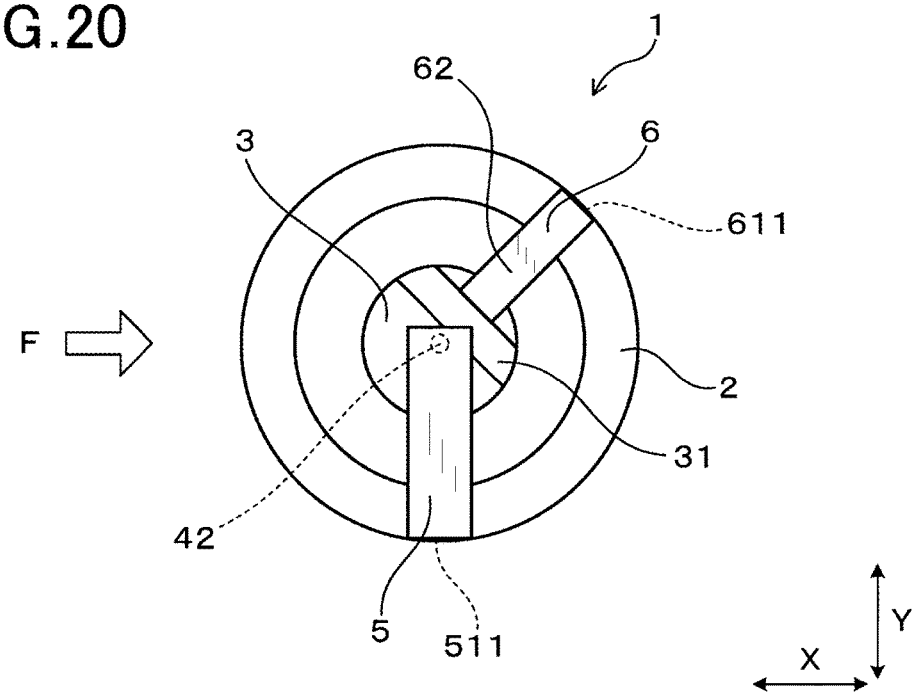
FIG. 20 is a diagram showing a plan view of a spark plug according to a sixth embodiment.
Figure 21:
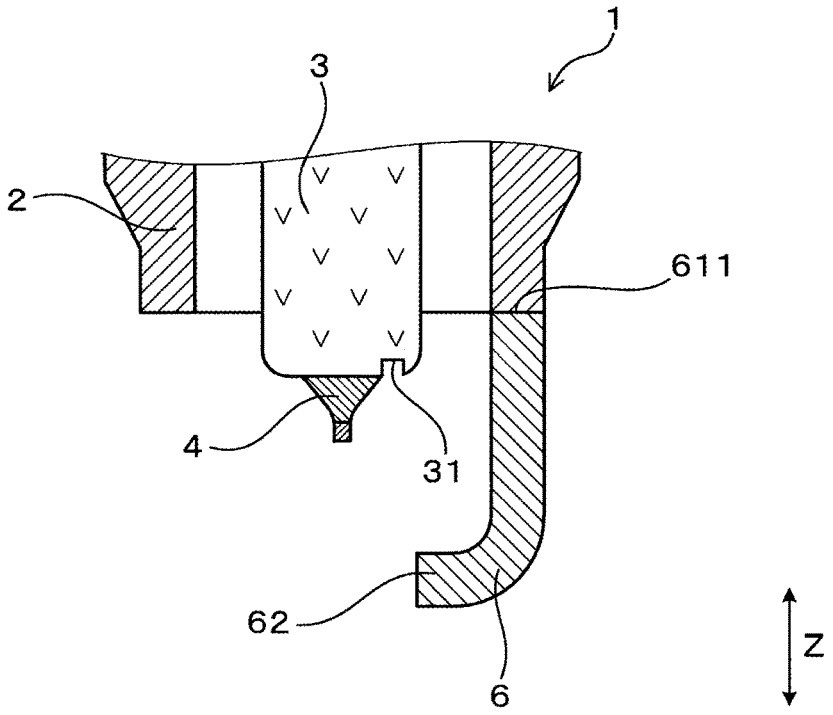
FIG. 21 is a diagram showing a cross-sectional view of a spark plug according to the sixth embodiment, sectioned though a groove portion and being perpendicular to a longitudinal direction of the groove portion.
Figure 22:
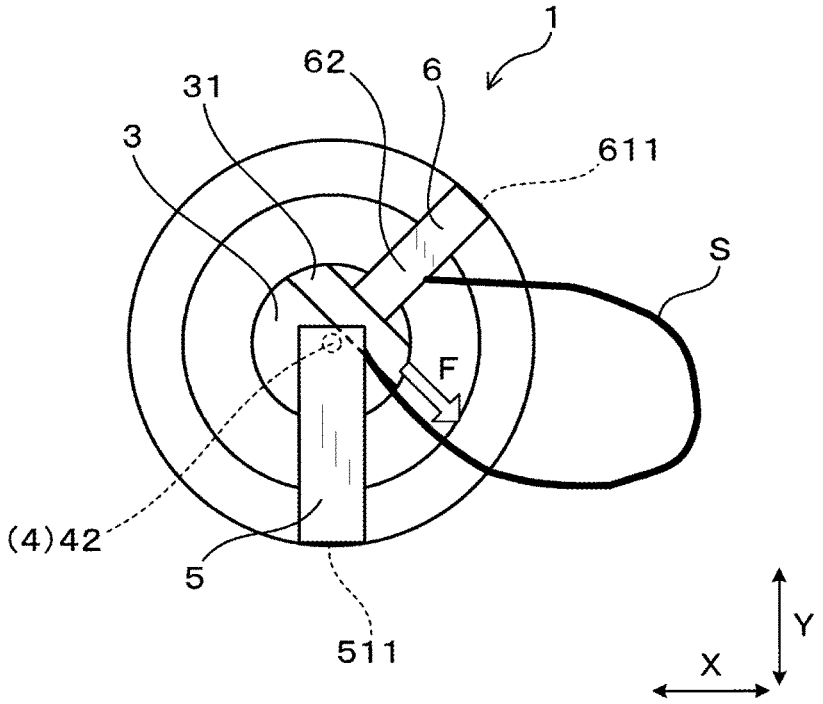
FIG. 22 is a diagram showing a plan view of the spark plug according to the sixth embodiment illustrating a state where a discharge spark is extended between the sub ground electrode and the center electrode according to the sixth embodiment.

As shown in FIGS. 20 to 22, the sixth embodiment has a configuration in which the tip end of the insulator 3 has a groove portion 31 recessed towards the base end side in the plug axial direction Z. One end of the groove portion 31 is opened towards a portion between the main connecting portion 511 and the sub connecting portion 611 in the circumferential direction. According to the present embodiment, one groove portion 31 is formed in the tip end portion of the insulator 2. The groove portion 31 is opened to both sides in a direction perpendicular to the plug axial direction Z. In other words, the groove portion 31 is formed continuously in a direction perpendicular to the plug axial direction Z from the one end to the other end of the tip end portion of the insulator 3. According to the present embodiment, the one end of the grove portion 31 is opened towards a center portion between the main connecting portion 511 and the sub connecting portion 611 in the circumferential direction. The groove portion 31 is formed in the sub connecting portion 611 side with respect to the center electrode 4. The groove portion 31 is formed to have a linear shape in a direction substantially perpendicular to a direction on which the sub inward portion 62 is formed. Note that illustration of the main ground electrode 5 is omitted in FIG. 21. Hereinafter, configurations that require no illustration for the explanation will be appropriately omitted. Other configurations are the same as those of the first embodiment.

According to the present embodiment, as shown in FIG. 22, the air stream in the combustion chamber 100 passes through the groove portion 31. Thus, the air stream is lead to flow through a portion between the main connecting portion 511 and the sub connecting portion 611. Hence, turbulence of the air stream can be avoided so that the discharge spark S can be further extended. Other configurations are the same as those of the first embodiment.

(Seventh Embodiment)

Figure 23:
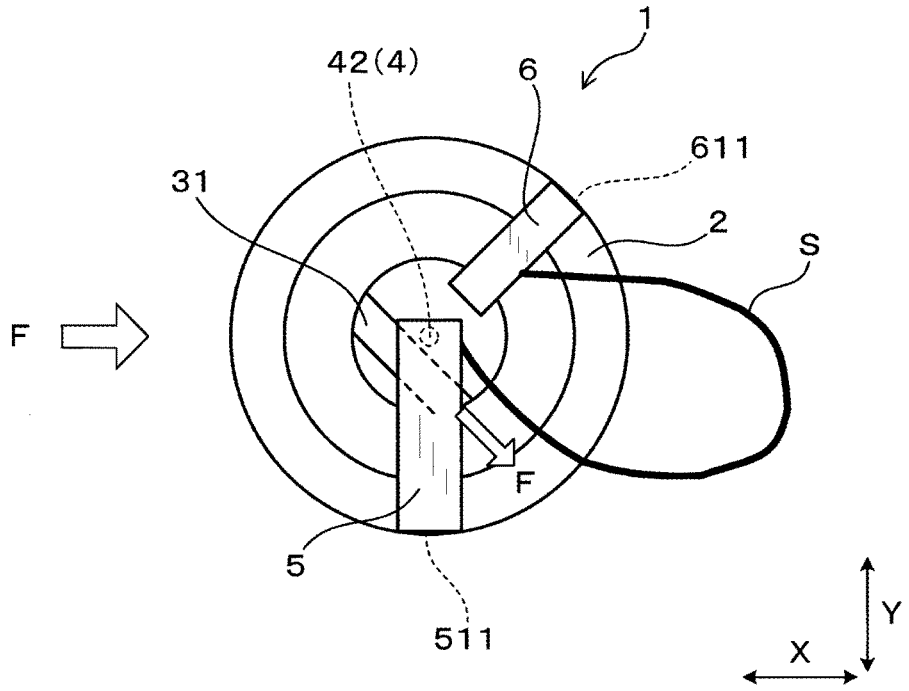
FIG. 23 is a diagram showing a plan view of the spark plug according to the sixth embodiment illustrating a state where a discharge spark is extended between the sub ground electrode and the center electrode according to the seventh embodiment.

According to the seventh embodiment, as shown in FIG. 23, the groove potion 41 is only formed in the opposite side of the sub connecting portion 611 side with respect to the center electrode 4. In other words, the groove portion 31 is formed in the upstream side with respect to the center electrode 4. Other configurations are the same as those of the first embodiment.

According to the present embodiment, a direction of the air stream is changed by the groove portion 41 before the air stream in the combustion chamber 100 collides with the center electrode 4. Thus, the air stream can be prevented from being disturbed when the air stream collides with the center electrode 4. Other configurations are the same as those of the sixth embodiment.

(Eighth Embodiment)

Figure 24:
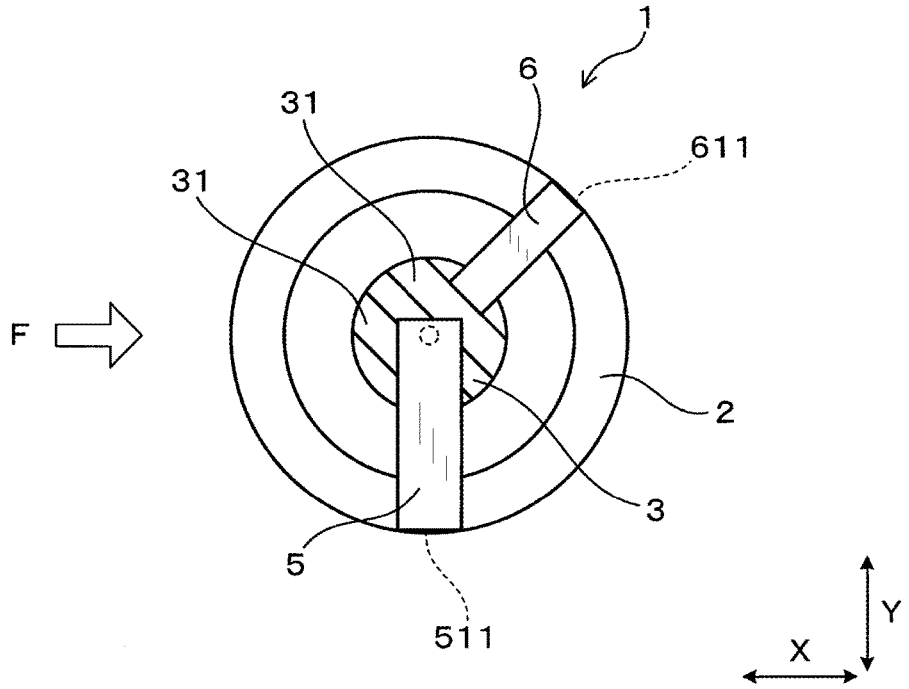
FIG. 24 is a diagram showing a plan view of the spark plug according to an eighth embodiment.
Figure 25:
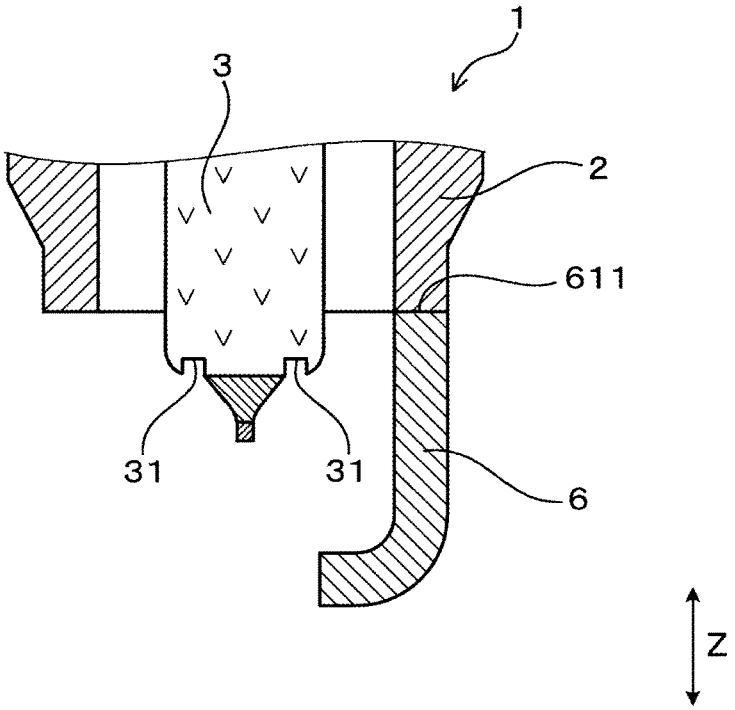
FIG. 25 is a diagram showing a cross-sectional view of a spark plug according to the eighth embodiment, sectioned though a groove portion and being perpendicular to a longitudinal direction of the groove portion.

According to the eighth embodiment, as shown in FIGS. 24 and 25, two grove portions 31 are formed in the tip end portion of the insulator 3. The grove portions 31 are formed in the sub connecting portion 611 side with respect to the center electrode 4 and the opposite side of the sub connecting portion 611 side. The two groove portions 31 are formed to be in parallel with each other. Other configurations are the same as those of the sixth and seventh embodiment.

According to the present embodiment, a plurality of groove portions 31 are formed, whereby the direction of the air stream can readily be changed to a portion between the main connecting portion 511 and the sub connecting portion 611. Other configurations are the same as those of the sixth and seventh embodiment.

(Ninth Embodiment)

Figure 26:
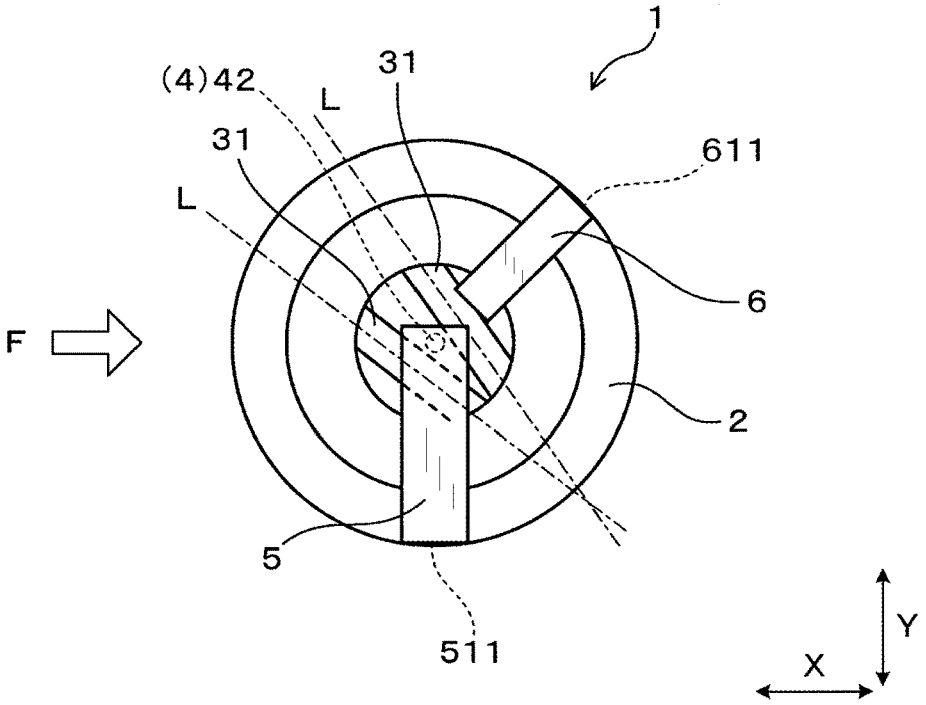
FIG. 26 is a diagram showing a plan view of the spark plug according to a ninth embodiment.

According to the ninth embodiment, as shown in FIG. 26, the basic structure is the same as that of the eighth embodiment, but the insulator 3 includes a plurality of groove portions 31 in which the longitudinal direction L of each grove portion 31 is inclined to each other, when viewed from the plug axial direction Z. According to the present embodiment, two groove portions 31 are inclined towards the downstream side to be close to each other. Other configurations are the same as those of the eighth embodiment.

According to the present embodiment, the two groove portions 31 effects the air stream to be concentrated at the specified point. Hence, the air stream can be more secured which passes through a portion between the man connecting portion 511 and the sub connecting portion 611. Then, the discharge spark S can be more easily extended. Other configurations are the same as those of the eighth embodiment.

Note that two groove portions 31 may be inclined to be apart from each other as it goes towards the downstream side. In this case, when viewed from the plug axial direction Z, the width of the air stream passing through a portion between the main connecting portion 511 and the sub connecting portion 611 can be widened, so that the discharge spark S can be wider.

(Tenth Embodiment)

Figure 27:
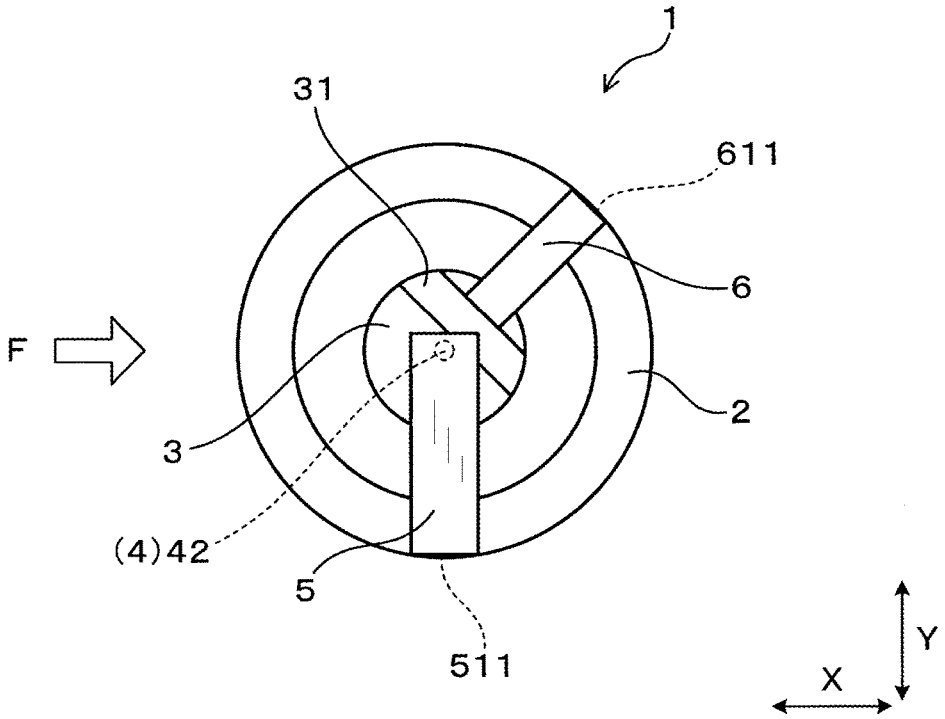
FIG. 27 is a diagram showing a plan view of the spark plug according to a tenth embodiment.
Figure 28:
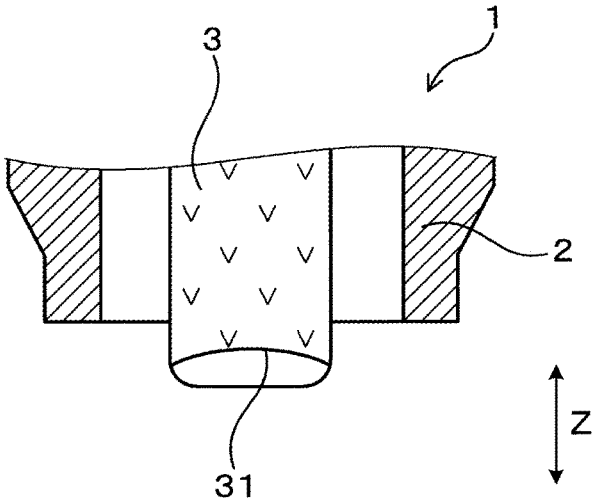
FIG. 28 is a diagram showing a cross-sectional view of a spark plug according to the tenth embodiment, sectioned though a groove portion and being parallel to a longitudinal direction of the groove portion.

According to the tenth embodiment, as shown in FIGS. 27 and 28, the basic structure is the same as that of the sixth embodiment, but the shape of the groove portion 31 is changed. Specifically, according to the tenth embodiment, the groove portion 31 is configured such that cross-sectional shape parallel to both of the longitudinal direction and the plug axis direction is a curved shape in which the base end side in the plug axial direction Z is protruded. According to the present embodiment, in the groove portion 31, the cross-sectional shape shows a convex-curved shape in the base end side in the plug axial direction. Other configurations are the same as those of the sixth embodiment.

According to the present embodiment, the air stream passing through the groove portion 31 flows towards the tip end side in the plug axial direction, that is, center portion in the combustion chamber 100. Thus, the discharge spark S can be extended to the center portion in the combustion chamber 100 easily. Hence, it is likely to avoid a fire extinguisher effect where heat of fire produced by the discharge spark S is absorbed by an engine head when the discharge spark S approaches the engine head. Other configurations are the same as those of the first embodiment.

(Eleventh Embodiment)

Figure 29:
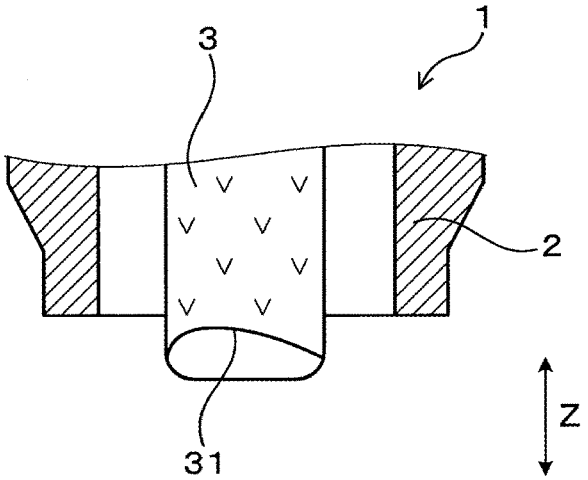
FIG. 29 is a diagram showing a cross-sectional view of a spark plug according to an eleventh embodiment, sectioned though a groove portion and being parallel to a longitudinal direction of the groove portion.

According to the eleventh embodiment, as shown in FIG. 29, the basic structure is the same as that of the tenth embodiment. However, a method of bending the groove portion 31 is changed. According to the present embodiment, the groove portion 31 is bent in the cross-section thereof such that the curvature in the upstream side is larger than the curvature in the downstream side. Other configurations are the same as those of the tenth embodiment.

According to the present embodiment, the air stream can be controlled easily to flow towards the tip end side in the plug axial direction Z, that is, the center portion of the combustion chamber 100. Thus, the discharge spark S is likely to be extended towards the center portion of the combustion chamber 100. Hence, it is likely to avoid a fire extinguish effect where heat of fire produced by the discharge spark S is absorbed by an engine head when the discharge spark S approaches the engine head. Other configurations are the same as those of the tenth embodiment and the same effects and advantages can be obtained.

(Twelfth Embodiment)

Figure 30:
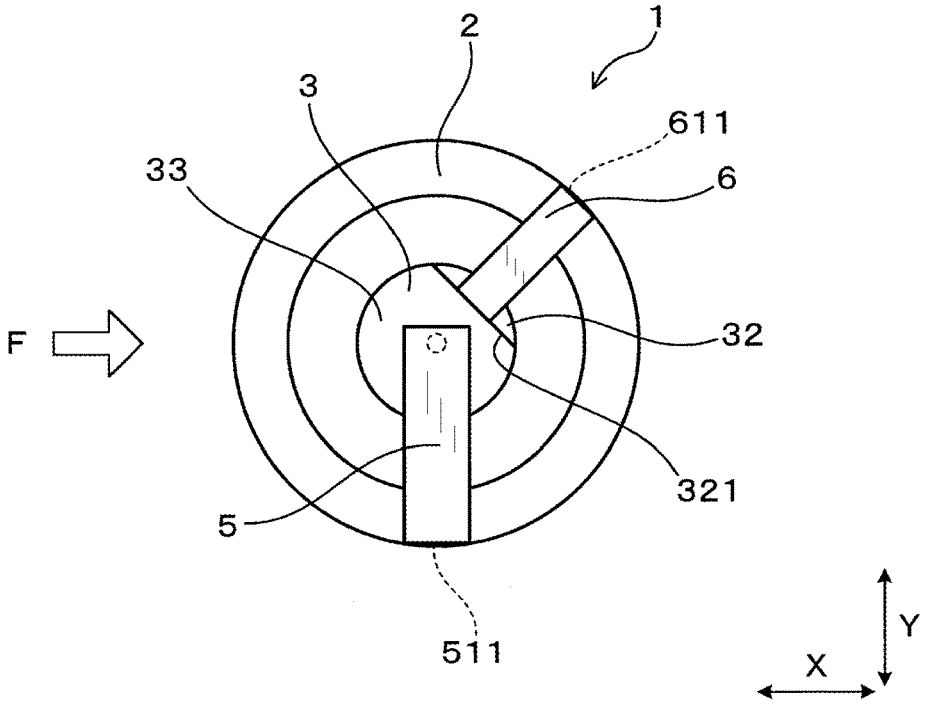
FIG. 30 is a diagram showing a plan view of the spark plug according to a twelfth embodiment.
Figure 31:
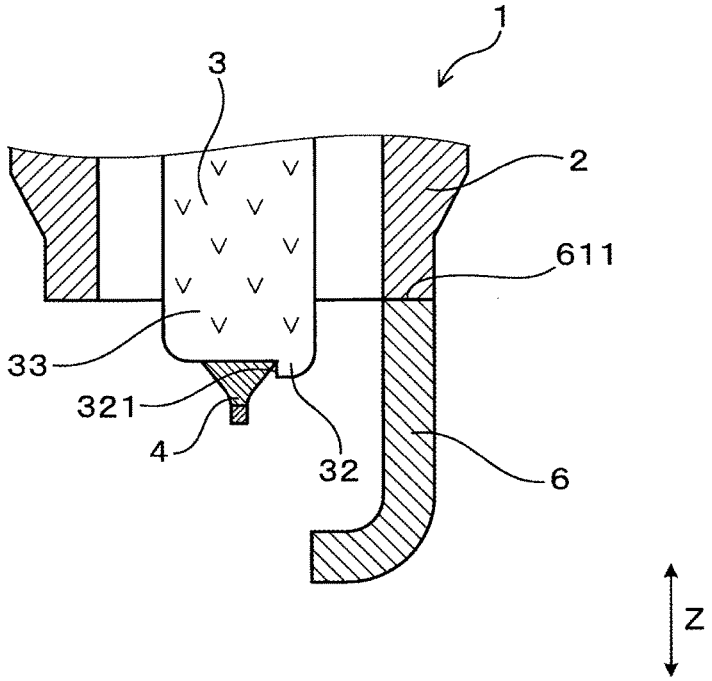
FIG. 31 is a diagram showing a cross-sectional view sectioned along a line perpendicular to an air guiding face according to the twelfth embodiment.

As shown in FIGS. 30 and 31, according to the twelfth embodiment, the tip end portion of the insulator 3 has a protrusion 32 protruded towards the tip end side in the plug axial direction Z. Further an air guiding face 321 facing the center electrode 4 side in the protrusion 32 is provided. The air guiding face 321 is in parallel to both of a linear line that connects either main connecting portion 511 or the sub connecting portion 611 and the plug center axis, and the plug center axis.

The tip end portion of the insulator 3 is protruded towards tip end side from the housing 2. The tip end portion of the insulator 3 includes the protrusion 32 and a base portion 33 other than the protrusion 32. That is, the protrusion 32 protrudes from the base portion 33 towards the tip end side. According to the present embodiment, the air guiding face 321 is formed on a surface parallel to both of a linear line connecting a substantially center portion between the main connecting portion 511 and the sub connecting portion 611 in the plug circumferential direction and the plug center axis, and the plug axial direction Z. Also, the tip end face of the base portion 33 is formed to cross substantially perpendicularly the plug axial direction Z. Other configurations are the same as those of the first embodiment.

According to the present embodiment, the air guiding face 321 of the protrusion 32 leads the air stream to flow through a portion between the main connecting portion 511 and the sub connecting portion 611. Hence, turbulence of the air stream can be avoided so that the discharge spark S can be further extended. Other configurations have the same effects and advantages as those of the first embodiment.

(Thirteenth Embodiment)

Figure 32:
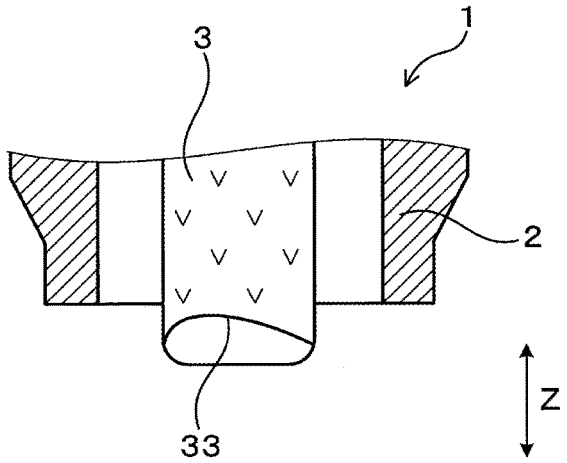
FIG. 32 is a diagram showing a cross-sectional view sectioned along a line parallel to air-flow direction of an air stream according to a thirteenth embodiment.

According to the present embodiment, as shown in FIG. 32, the shape of the base portion 33 in the tip end portion of the insulator 3 is changed from the twelfth embodiment. In other words, the tip end face of the base portion 33 has a curved shape protruding towards the base end side in the plug axial direction Z. The tip end face of the base portion 33 is bent such that the curvature in the upstream side is larger than that of the downstream side. Note that FIG. 2 illustrates a cross-section parallel to the air flow direction F of the air stream, and the illustration of the protrusion 32 is omitted. Other configurations are the same as those of the twelfth embodiment.

According to the present embodiment, the base portion 33 is able to lead the air stream to flow towards the plug axial direction Z, while the same effects as the twelfth embodiment is obtained. Thus, it is likely to avoid a fire extinguisher effect where heat of fire produced by the discharge spark S is absorbed by an engine head. The same effects and advantages as the twelfth embodiment can be obtained from configurations other than the above-described configuration in this embodiment.

(Fourteenth Embodiment)

Figure 33:
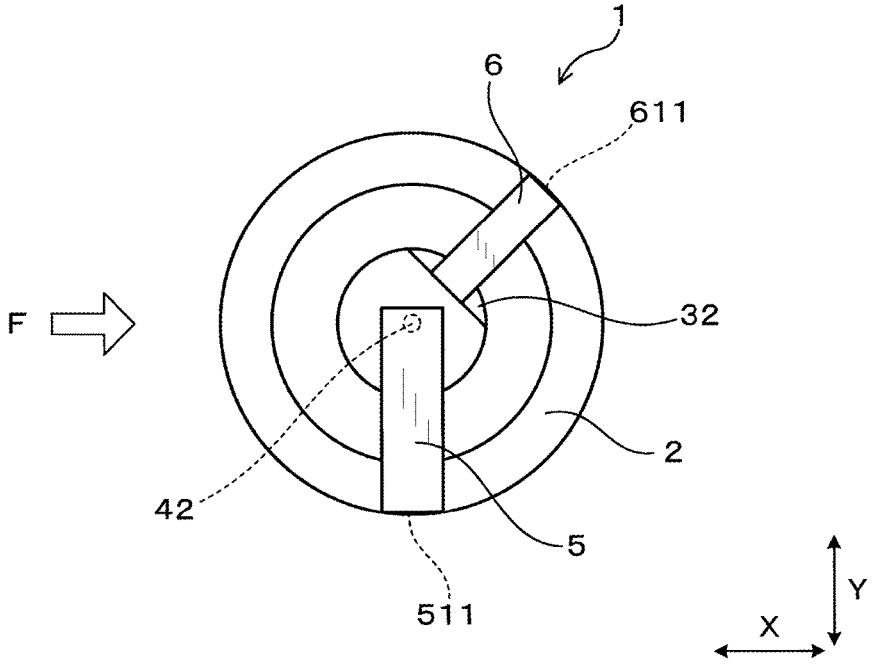
FIG. 33 is a diagram showing a plan view of a spark plug according to a fourteenth embodiment.
Figure 34:
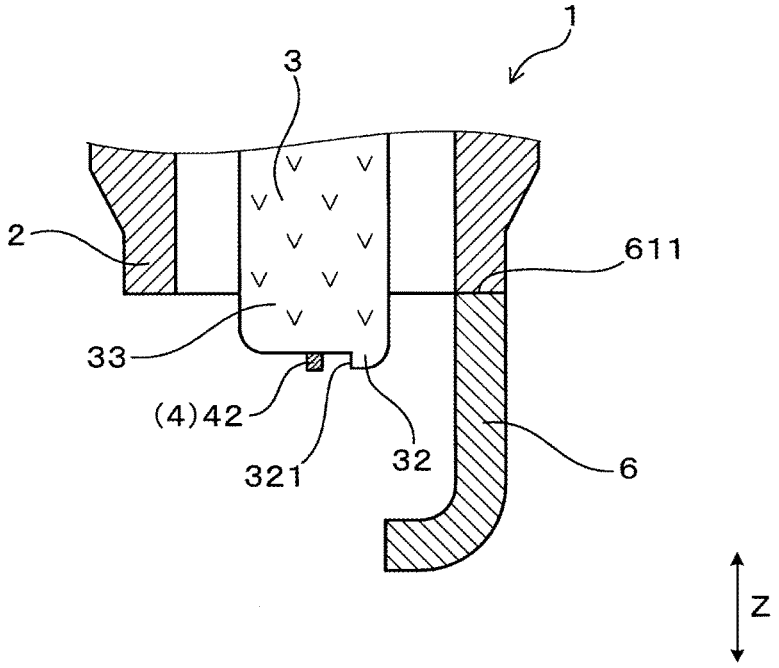
FIG. 34 is a diagram showing a cross-sectional view of the spark plug sectioned along a line perpendicular to an air guiding face according to the fourteenth embodiment.

According to the fourteenth embodiment, as shown in FIGS. 33 and 34, the basic structure is the same as that of the twelfth embodiment. However, the tip end of the protrusion 32 is positioned at a position similar to the tip end position of the center electrode, or at a position farther to the tip end side in the plug axial direction Z than the tip end position of the center electrode is. The tip end face of the base portion 33 in the tip end portion of the insulator 3 is formed in substantially the same position as that of the base end portion of the center electrode chip 42. The tip end of the protrusion 32 is formed at substantially the same position as that of the tip end face of the center electrode 42. Other configurations are the same as those of the twelfth embodiment.

According to the present embodiment, the air stream is readily prevented from being disturbed by the tip end portion of the center electrode 4. Other configurations are the same as those of the twelfth embodiment and the same effects and advantages can be obtained.

(Fifteenth Embodiment)

Figure 35:
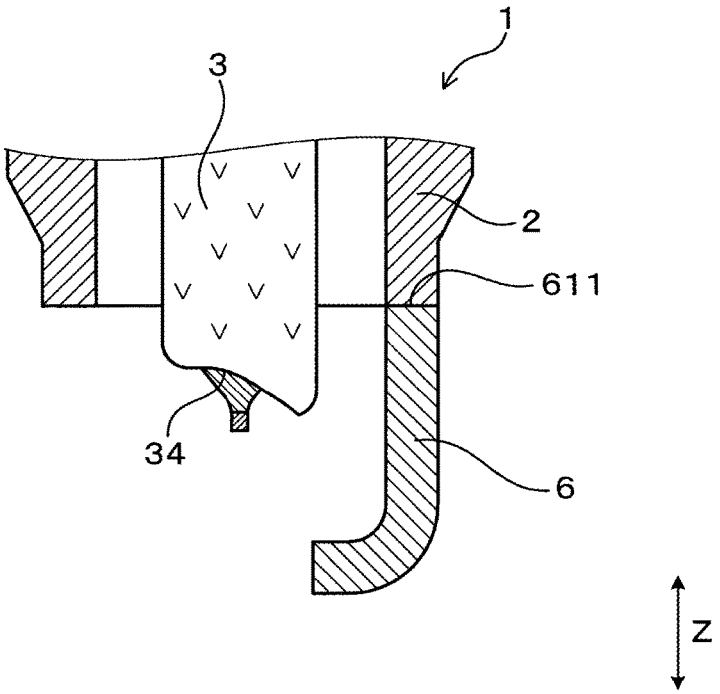
FIG. 35 is a diagram showing a cross-sectional view of a spark plug sectioned along a line parallel to air-flow direction of an air stream according to a fifteenth embodiment.
Figure 36:
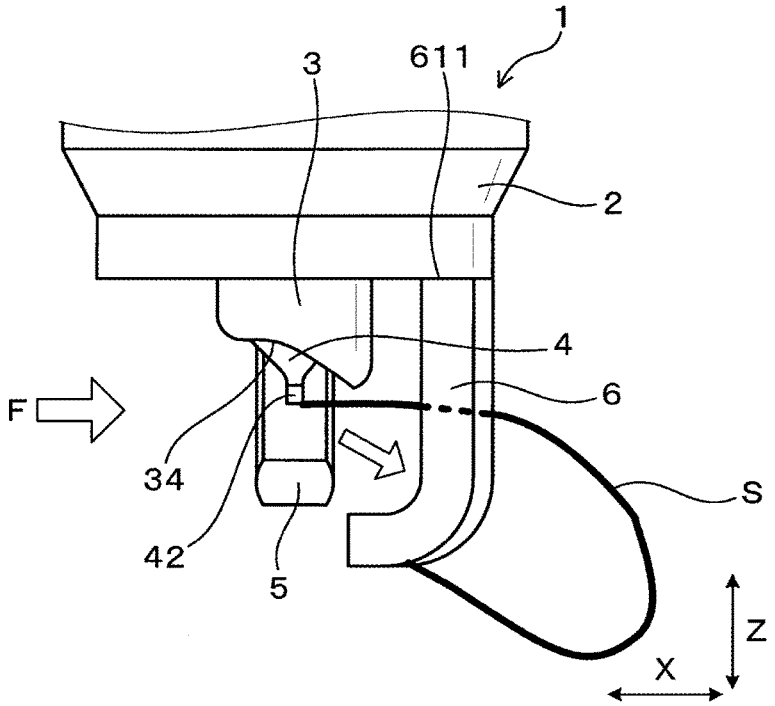
FIG. 36 is a diagram showing a front view of the spark plug according to the fifteenth embodiment.

According to the fifteenth embodiment, as shown in FIGS. 35 and 36, the shape of the tip end face 34 of the insulator 3 is changed from that of the first embodiment. Specifically, the tip end face 34 of the insulator 3 is curved towards the tip end side in the plug axial direction as it goes towards the downstream side of the air stream in the combustion chamber 100, having a curved shape protruding towards the downstream side of the air stream in the combustion chamber 100. According to the present embodiment, the tip end face 34 of the insulator 3 is formed from an end portion in the upstream side to a region in the downstream side.

According to the present embodiment, as shown in FIG. 36, the tip end face 34 of the insulator 3 is able to lead the air stream towards the tip end side in the plug axial direction Z. Thus, it is likely to avoid a fire extinguish effect where heat of fire produced by the discharge spark S is absorbed by an engine head. The same effects and advantages as the first embodiment can be obtained from configurations other than the above-described configuration in this embodiment. Other configurations are the same as those of the twelfth embodiment.

The present disclosure is not limited to the above-described embodiments but can be modified in various ways without departing the spirit of the present disclosure. For example, in the respective embodiments, the main inward portion may be configured to incline towards the tip end side in the plug axial direction as it goes towards the inner periphery side in the plug radial direction. Also, a plurality of ground electrodes may be provided.

What is claimed is:

1. A spark plug of an internal combustion engine, the spark plug capable of being attached to the internal combustion engine having a combustion chamber, producing a discharge spark in the combustion chamber, the spark plug comprising:

a housing having a cylindrical shape;

an insulator supported inside the housing;

a center electrode supported inside the insulator;

a main ground electrode having a main connecting portion connected to the housing and forming a discharge gap between the main ground electrode and the center electrode; and a sub ground electrode having a sub connecting portion connected to the housing at a portion different from the main connecting portion in a circumferential direction of the spark plug, wherein a direction of air flow intercepts a direction defined as a line connecting the main connecting portion and the center electrode at a plug center axis;

the sub connecting portion is located further downstream of the air stream in the combustion chamber than a position of the main connecting portion;

a tip end position of the sub ground electrode in the plug axial direction is located farther away from the housing than a tip end position of the main ground electrode in the plug axial direction; and the sub ground electrode is configured such that an end point of the discharge spark is movable on the sub ground electrode, when the end point of the discharge spark produced in the discharge gap moves to the sub ground electrode from the main ground electrode.

2. The spark plug according to claim 1, wherein the sub ground electrode includes a sub stand portion that stands towards a tip end side in the plug axial direction from the housing, and a sub inward portion that extends towards an inner periphery side of the plug in a radial direction thereof from the sub stand portion; and the sub inward portion is formed along the air flow direction.

3. The spark plug according to claim 1, wherein the sub ground electrode includes a sub stand portion that stands towards a tip end side in the plug axial direction from the housing, and a sub inward portion that extends towards an inner periphery side of the plug in a radial direction thereof from the sub stand portion;

the sub inward portion has an edge portion which is continuously formed to have a linear shape; and the edge portion, when being closer to the downstream side, is inclined towards the tip end side of the plug axial direction.

4. The spark plug according to claim 3, wherein the sub inward portion includes a sub inward side surface which is perpendicular to a width direction of the sub inward portion, and a sub taper surface which is adjacent to the sub inward side surface;

the sub taper surface is configured such that the closer to a radial direction outer periphery side, the closer to an outside in the width direction of the sub inward portion;

the sub taper surface is inclined towards the inward with respect to the width direction, when being closer to tip end side of the plug axial direction; and a boundary portion between the sub inward side surface and the sub taper surface is defined as the edge portion.

5. The spark plug according to claim 1, wherein the main ground electrode includes a main stand portion that stands towards tip end side from the housing in the plug axial direction, and a main inward potion that is extended towards the inner periphery side in a radial direction of the plug from the main stand portion; and a main inward end face which is an end face in the inner periphery side of the main inward portion in a radial direction of the plug is disposed in a main connecting portion side than the plug center axis.

6. The spark plug according to claim 1, wherein a tip end of the insulator has a groove portion recessed towards a base end side in the plug axial direction; and one end of the groove portion is opened towards a portion between the main connecting portion and the sub connecting portion.

7. The spark plug according to claim 6, wherein the groove portion is configured such that cross-sectional shape parallel to both of a longitudinal direction and the plug axis direction is a curved shape in which the base end side in the plug axial direction is protruded.

8. The spark plug according to claim 6, wherein the insulator includes a plurality of groove portions in which the longitudinal direction of groove portions are inclined to each other, when viewed from the plug axial direction.

9. The spark plug according to claim 1, wherein a tip end portion of the insulator includes a protrusion;

an air guiding face facing a center electrode in the protrusion is provided;

the air guiding face is parallel to both of a linear line that connects either main connecting portion or the sub connecting portion and the plug center axis, and the plug center axis.

10. The spark plug according to claim 9, wherein a tip end position of the protrusion is located at a substantially the same position as a tip end position of the center electrode, or is positioned in farther tip end side in the plug axial direction than the tip end position of the center electrode is.

11. The spark plug according to claim 1, wherein a tip end face of the insulator is curved towards the tip end side in the plug axial direction as it goes towards the downstream side of the air stream in the combustion chamber, having a curved shape protruding towards the downstream side of the air stream in the combustion chamber.

* * * * *